US005868388A

United States Patent [19]

Wood et al.

[11] Patent Number: 5,868,388

[45] **Date of Patent: *Feb. 9, 1999**

[54] GAMES AND PUZZLES

[76] Inventors: Mark Thornton Wood, 2 Southport Avenue; Francis Henry Dyksterhuis, 58 Wongawallan Road, both of Eagle Heights, Australia, Qld 4271

[ * ] Notice: This patent issued on a continued prosecution application filed under 37 CFR 1.53(d), and is subject to the twenty year patent term provisions of 35 U.S.C. 154(a)(2).

[21] Appl. No.: 750,493

[22] PCT Filed: May 31, 1995

[86] PCT No.: PCT/AU95/00318

§ 371 Date: Nov. 26, 1995

§ 102(e) Date: Nov. 26, 1996

[87] PCT Pub. No.: WO95/32775

PCT Pub. Date: Dec. 7, 1995

[30] Foreign Application Priority Data

May 31, 1994 [AU] Australia ..... PM 5963

[51] Int. Cl.[6] ..... A63F 9/10

[52] U.S. Cl. ..... 273/157 R

[58] Field of Search ..... 273/157 R, 160, 273/156, 153 R, 287, 282.1, 283

[56] References Cited

U.S. PATENT DOCUMENTS

| | | | |
|---|---|---|---|
| 231,963 | 9/1880 | Luers | 273/157 R |
| 1,380,998 | 6/1921 | Millard | 273/157 R |
| 1,702,505 | 2/1929 | Groves | 273/157 R |
| 1,752,248 | 3/1930 | Fransen | 273/157 R |
| 2,170,909 | 8/1939 | Moren | 273/157 R |
| 3,638,949 | 2/1972 | Thompson | 273/157 R |
| 4,583,742 | 4/1986 | Slinn | 273/157 R |
| 4,699,385 | 10/1987 | Bifulco | 273/157 R |
| 5,403,005 | 4/1995 | Avila-Valdez | 273/157 R |

OTHER PUBLICATIONS

Jerry Slocum, et al., "Compendium of Checkerboard Puzzles" (1993).

*Primary Examiner*—Steven Wong

*Attorney, Agent, or Firm*—Amster, Rothstein & Ebenstein

[57] ABSTRACT

A game or puzzle including a plurality of polyomino pieces which have the obverse sides and the reverse sides marked with different markings, there being a least three markings in total on the obverse and reverse sides of the piece. The pieces may be assembled using both sides into different arrays of eight by eight squares defining checkerboard patterns for use in playing the game of chess or checkers. The pieces may also be assembled into a cube comprising four by four squares.

54 Claims, 17 Drawing Sheets

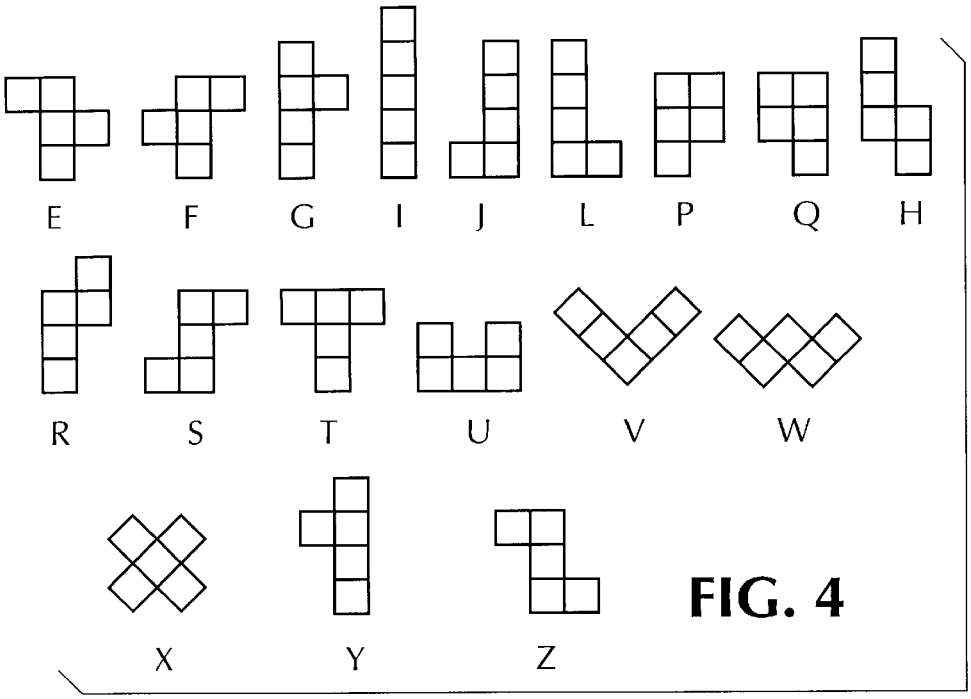
FIG. 4
FIG.5
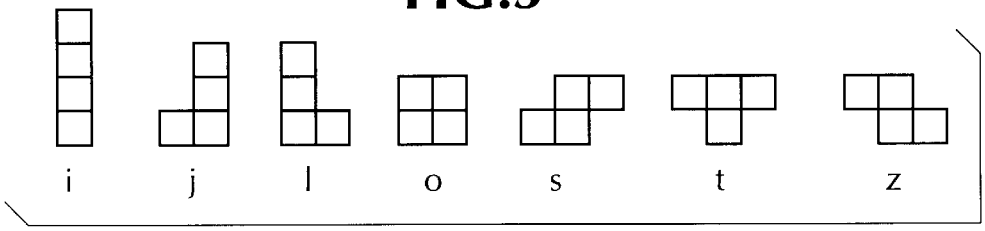
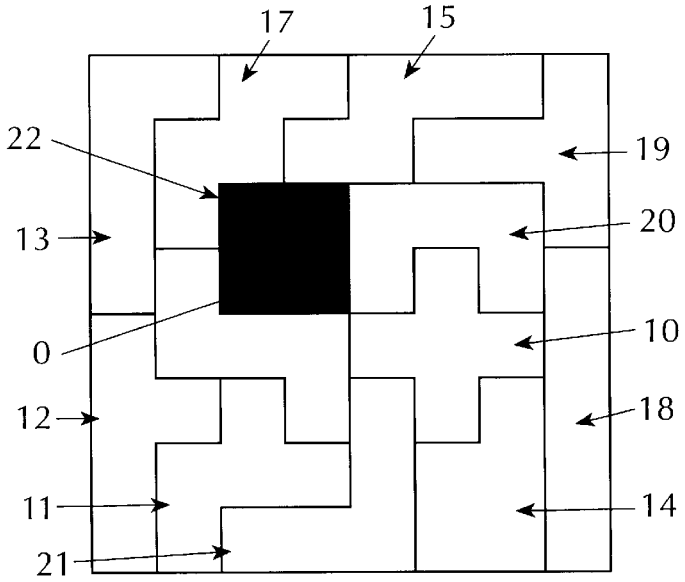
FIG. 6

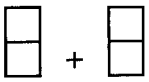
FIG. 7(iii)

FIG. 16
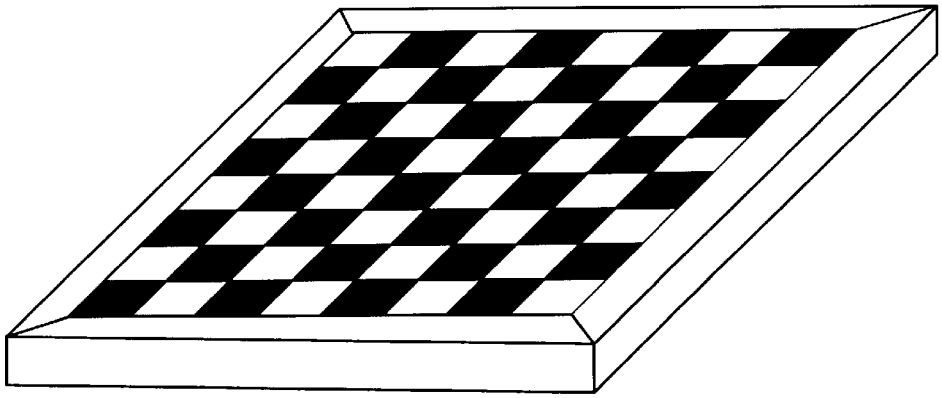
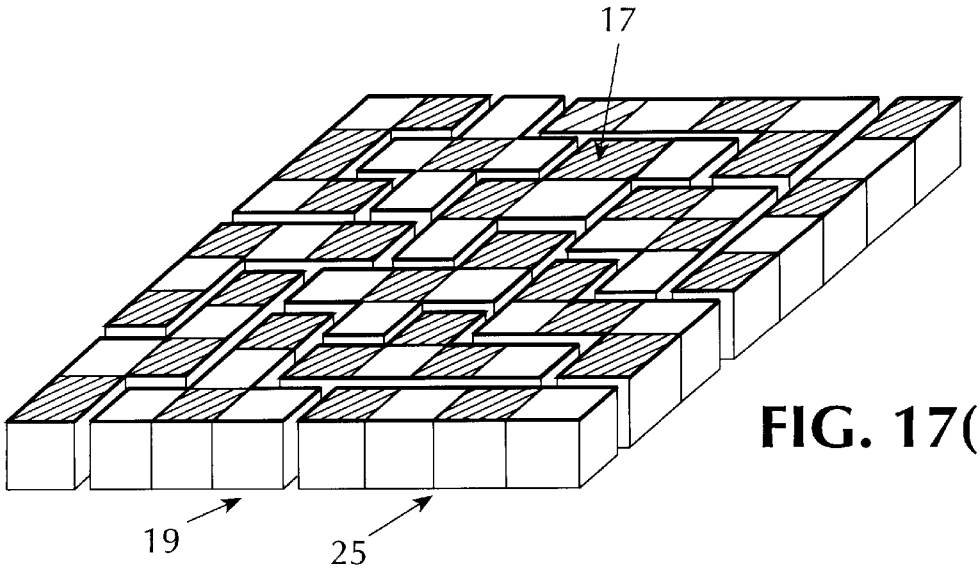
FIG. 17(a)
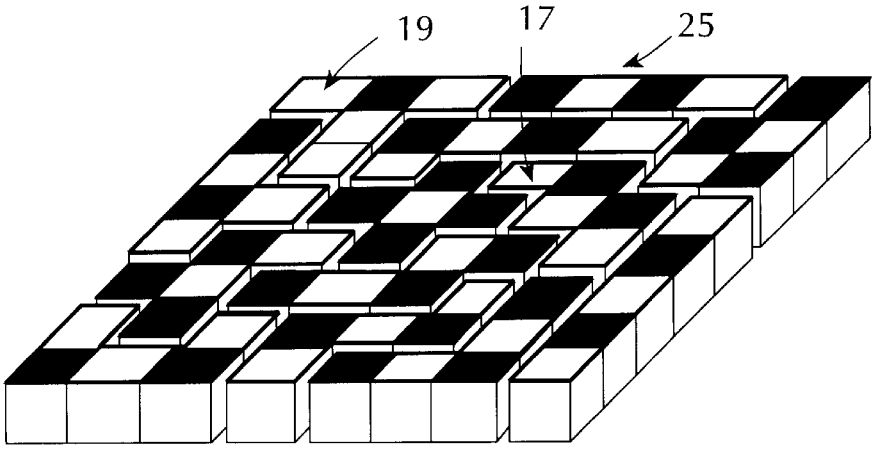
FIG. 17(b)

W

M

E

GAMES AND PUZZLES

TECHNICAL FIELD

The invention relates to games and puzzles, having the goal of stimulating the mental faculties. The present invention in particular relates to checkered board games or puzzles that use pentominoes or generally any polyominoes.

BACKGROUND ART

Many two coloured checkered board puzzles and games of the type involving the assembly of a number of different pieces have been developed in the past but most such puzzles and games provide a fairly limited challenge. Examples of such puzzles are disclosed in the publication COMPENDIUM OF CHECKER BOARD PUZZLES by JERRY SLOCUM AND JACQUES HAUBRICH published August 1993. Further examples are shown in the FRANSEN 1930 U.S. Pat. No. 1,752,248 relating to an educational puzzle, an 1892 U.K. Patent No 16810 relating to a checkerboard puzzle and LUERS 1880 U.S. Pat. No. 2,319,63 relating to a sectional checkered board puzzle. Even though their challenge itself may be formidable in certain cases, the puzzles or games often lose part of their appeal after the challenge has been met.

The area of mathematics dealing with polyominoes is called combinatorial geometry and information relating to such games and puzzles, including pentominoes, may be found in the publication "Polyominoes" by Solomon W. Golomb (1965). A puzzle comprising a rectangular board composed of twelve pentominoes is disclosed in the 1959 U.S. Pat. No. 2,900,190 to Pestieau. A 1993 Pentominoes game marketed by the Binary Arts Corporation Inc. builds on Golomb's 1965 work. The 1976 U.S. Pat. No. 3,964,749 to Wadsworth also discloses a puzzle involving pentominoes for a rectangular board of ninety squares.

Many puzzles have also been constructed over the past century that involve the cutting up of a standard chess board in any number of pieces and each piece can comprise a varying number of squares. These pieces include pentominoes as well as higher or lower order polyominoes. In any of these puzzles, the test is to reassemble the chess board out of its constituent pieces. No relationship has ever been established between an obverse side and a reverse side of the puzzle pieces. Whenever the pieces were coloured in a checkered pattern on both sides, the colouring was either identical or the exact opposite. No difference between the obverse and reverse sides has ever been demonstrated nor has the interchange of colours (and patterns) between pieces from the obverse and reverse of the puzzle ever been alluded to.

SUMMARY OF THE INVENTION

The present invention aims to provide a checker board puzzle or game with increased complexity and as a consequence tremendous additional variability. The present invention aims to provide a puzzle or game which allows challenges to the individual ranging from the simple to the extremely difficult. The possible uses of the present invention in its various game forms will give it great versatility. The game of chess has enjoyed a wide acceptance and represents beyond a doubt a challenge that will last. The invention at hand will lay claim to a similarly wide audience but with the possible options of extensions to very different puzzle or game domains.

The present invention further aims in one preferred aspect to provide a challenge to use polyomino pieces of any given set in association with a recessed board wherein the pieces may be returned to the recessed area of the board in order to obtain a predescribed pattern. Such pattern may comprise a checker board or territorially checkered board.

The present invention thus provides in a first aspect a puzzle comprising a plurality of polyomino pieces, each said piece having on opposite sides one or more squares, said squares in each said piece and on said opposite sides having markings such that said pieces are capable of being assembled using their obverse sides only into one or more solutions comprising eight by eight squares with the markings of the squares on said obverse side of said assembled pieces forming a checkered board pattern of two alternate markings which may be used for playing a checkers or chess type game, and wherein said pieces may be further assembled using their reverse sides only into one or more solutions comprising eight by eight squares forming a further checkered board pattern of two alternate markings, said markings of said squares in total on both sides of said pieces comprise three or more different markings and wherein the said solutions obtained using the obverse sides of said pieces are different from the said solutions obtained using the reverse sides of said pieces.

The term "marking" as used throughout the specification and claims includes colours or any other form of identification. In addition, the term "colour" as used above and throughout the specification including the claims includes white and black. Thus, the playing pieces of the puzzles may be for example, a checkered board pattern comprising the colours blue and white, whilst when assembled using their opposite sides the playing pieces may form a checkered board pattern of black and white. The puzzle, in this instance, thus has three colours, blue, black and white. In the case of a conventional checkered board, two marking combinations may be provided, such as blue/white or black/white to form the alternate light and dark markings. The term "colours" also includes different contrasting shades of the one colour, for example light blue and dark blue. Thus, a reference to two colours or different colours includes, for example light and dark shades of the one colour. The identification means may comprise any distinguishing markings, for example stripes, figures, letters or characters.

The markings may be inherent in the pieces or applied to the pieces, for example by painting, printing or by the application of transfers or stickers.

The tern "polyomino pieces" as used herein includes ominoes or monominoes (comprising from the top, one square) dominoes (two squares), triominoes or trominoes (three squares), tetrominoes (four squares), pentominoes (five squares), hexominoes (six squares), heptominoes (seven squares) and octominoes (eight squares) and used either exclusively from their own type or in combination with one or more drawn from other polyomino types. The term "polyomino pieces" as used herein also includes physical pieces or representations thereof such as representations on a video or computer screen. In pieces other than monominoes, the squares or cubes in each piece have markings in an alternating pattern on both obverse and reverse sides. Thus, in the case of a domino, when one square is marked dark, the other square will be marked light. An omino may have for example a light or dark obverse coupled with a light or dark reverse giving three distinct combinations. The pieces may also be of thin planar form, or for example three dimensional cube form (one square unit in height) or multiples thereof.

The present invention provides in a further aspect a puzzle comprising a plurality of polyomino pieces comprising twelve pentomino pieces and one tetromino piece, each said pentomino piece being of a shape different from the other pentomino pieces and defining one or more squares on opposite sides, the squares of each said piece being alternately marked on the obverse and reverse sides such that said pieces are capable of being assembled using their obverse sides only into one or more solutions comprising eight by eight squares forming a checkered pattern of alternate markings which may be used for playing a checkers or chess type game, and wherein said pieces are capable of being further assembled using their reverse sides only into one or more solutions comprising eight by eight squares forming a checkered pattern of alternate markings which may be used for playing a checkers or chess type game, said markings comprising at least three different markings and wherein said solutions obtained using said obverse sides of said pieces are different from the solutions obtained using the reverse sides of said pieces.

In yet a further aspect the present invention provides a games board having an outer border and a base, said border surrounding and defining a square recess for receipt of the polyomino pieces, the pieces when assembled occupying substantially all of the recess, such that the assembly of pieces and board forms a playing board defining a playing surface comprising an array of eight by eight alternately marked squares.

In one configuration, the playing pieces may be marked so as to form a puzzle having four different markings or colours. For example, the playing pieces when assembled may define a checkerboard pattern of the colours red and white on the obverse side and on the reverse side, a checkerboard pattern of the colours yellow and black.

In a further form, the playing pieces may be assembled to define a "half board" defining a checkerboard wherein in relation to a designation north, south, east and west, the south half of the checkerboard is formed in two contrasting colours or other markings, for example red and white, whilst the north half is formed in other contrasting colours, for example black and white. A light square is always required in the lower right hand corner of chess and draught playing boards. Further assembly of the puzzle pieces may reverse the colour or marking combinations such that for example, the western half of the puzzle may be coloured black and white whilst the eastern half is coloured red and white.

In yet a further manner of assembly, the colour or marking separation may be formed diagonally of the board such that for example on one diagonal half side of the board, the pieces define a checkered-board pattern comprising the colours red and white whilst on the opposite diagonal half side of the board, the checkerboard pattern is black and white.

In yet a further configuration, the pieces may be selected from three sets of colour pairs. It may then be possible to construct boards where on the obverse side, the checkered pattern is maintained in one pair of colours (for example black/grey) whilst on the reverse side, the pieces may be rearranged to form a "half board" where one half uses the second colour pair, (for example dark green/light green) and the other half the third colour pair (for example dark red/light red). The total selection of six colours will, in special circumstances, allow the construction of boards that have unique features. One such feature is seen in a board where no single piece is adjoined by any other piece having the same colour combination (an "untouchable" board).

Similarly, it will be possible to extend the number of colours, up to eight (for example in four colour pairs) or even higher. Four colour pairs could be used to yield two "half boards" backing onto each other. For example, obverse in black/grey on one half and yellow/white on the other half, whilst the reverse is red/orange and blue/green. Although a multitude of colours will generally lead to many chaotic looking configurations, they may yet serve to give some aesthetic configurations in particular cases.

Most commonly, each piece will have either on its obverse side or reverse side a maximum of two different markings, for example red and white in its respective squares. In some configurations, however, the sides may carry more than two markings still forming a checkered pattern. For example, a piece may have its squares marked black/white/blue/white still forming a checkered pattern. A puzzle assembled with such pieces will form a coherent checkered pattern and in some cases half boards comprising two markings on one side of the array and two markings on the other side of the array with one marking in common. In this configuration, the piece with three different markings would span the boundary between the halves of the assembled puzzle.

In a further aspect, the pieces of the puzzle may be assembled into a three dimensional cube comprising on each side four by four squares. For formation of a cube, the lateral sides of the pieces may be marked such that each side of the cube shows a checkered pattern comprised of the markings carried by the obverse, reverse and lateral sides of the pieces. A cube may be formed such that three adjacent faces comprise checkered patterns of two markings and the other three adjacent faces having a checkered pattern of the other two markings. One of the markings may be common to all faces. For example, three faces of the cube may be checkered red and white, whilst the other three faces may be checkered black and white.

Where a cube is to be formed using the twelve unique pentomino pieces and one tetromino piece, the pentomino piece comprising five aligned cubes cannot be used to form a cube having a four by four by four square or cube pattern. That pentomino piece can be omitted which will result in a cube having a hollow interior. Alternatively, that pentomino piece can be replaced by a composite piece which can be used as a tetromino piece but which includes an additional cube extending to one side of the tetromino piece.

Of course, in the above configurations, it will be appreciated that the colour combinations can be any contrasting colours or shades of colours as required.

In a further aspect, the invention provides a puzzle comprising on a computer or video screen images of a plurality of polyomino pieces, each image having opposite sides and the opposite sides of each said image defining one or more squares, each square carrying markings, the images of said pieces on the obverse side only being capable of being assembled into an array defining eight by eight squares having a checkered pattern of said markings and said images of said pieces on the reverse side only being capable of being assembled into a further array defining eight by eight squares having a checkered pattern of said markings, there being at least three different markings in total on said opposite sides of the images of said pieces, and wherein the arrays obtained using the obverse sides of said images are different from the arrays obtained using the reverse sides of said images.

The pieces used in the puzzle of the invention are all either unique in shape or unique in pattern. That is no one piece used in the puzzle is the same as another piece. Where pieces of the same shape are used, they are distinguished by having a different pattern.

BRIEF DESCRIPTION OF THE DRAWINGS

The invention will further be described by reference to preferred embodiments thereof as illustrated in the accompanying drawings and wherein:

FIG. 4 illustrates in plan view the pentomino pieces identified by capital letters;

FIG. 5 illustrates in plan view the tetromino pieces identified by small letters;

FIG. 6 illustrates in plan view a typical solution to a puzzle according to one form of the present invention using the "o" tetromino and twelve pentominoes;

FIG. 16 illustrates the playing board provided with a set of playing pieces defining a conventional chess or checker board;

FIG. 17 (*a*) and (*b*) illustrate typical checkered board solutions using both sides of the pieces;

FIG. 28 (*c*) illustrates a solution possible with the colour combination of FIG. 28 (*a*) and (*b*).

FIG. 43 illustrates the use of the polyomino puzzle pieces to represent mathematical problems.

DETAILED DESCRIPTION OF THE INVENTION

The present invention in one aspect constitutes a puzzle in as much as that the pieces have to be placed on a board in a manner so as to construct a predetermined pattern or picture. Part of the objective is to construct a standard eight by eight squares chess board or checker board suitable for playing chess or checkers or alternatively a modified board to be played with or without modified playing rules. The board and pieces are to be made according to a variety of physical dimensions, each giving rise to particular properties connected with the board in question and affecting the problem solving and/or aesthetic properties.

The polyominoes can be chosen in millions of different ways incorporating subtle changes, which may not affect the checkered appearance of the eight by eight chess board solutions but which will dramatically affect the colour patterns of individual pieces and consequently assembly.

Figure 1:
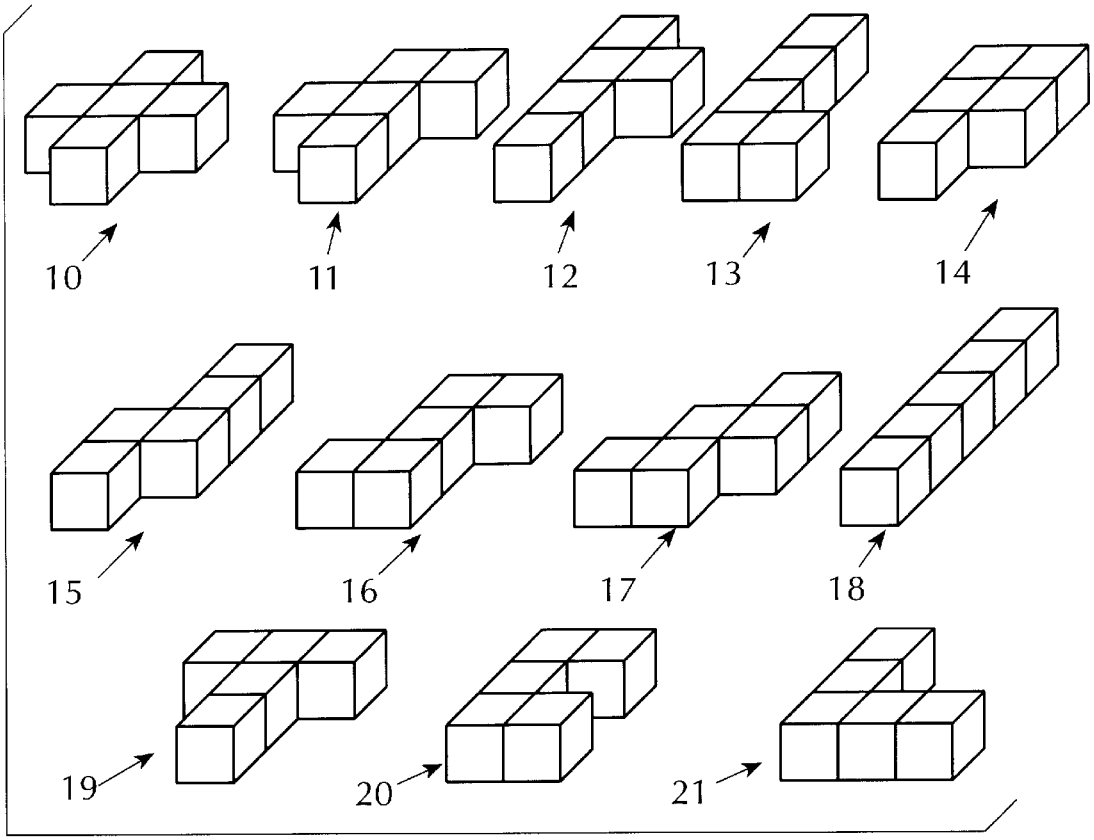
FIG. 1 illustrates a typical set of twelve pentomino pieces for use in games or puzzles of the present invention where height, breadth and depth reflect pentominoes composed from three dimensional cubes rather than two dimensional squares.
Figure 2:
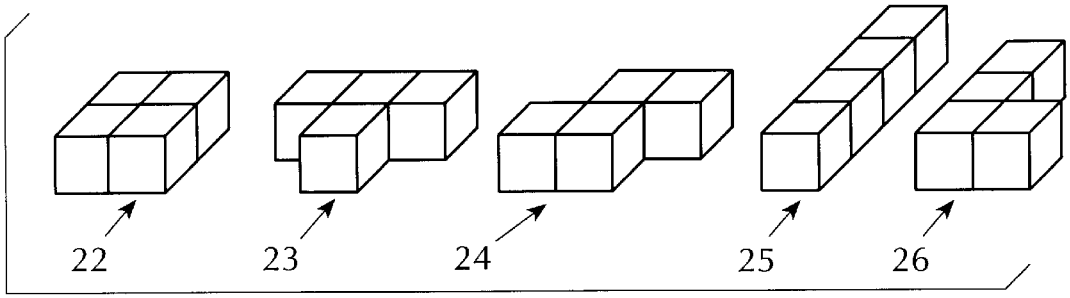
FIG. 2 illustrates typical tetromino pieces for use in the games or puzzles also composed of cubes.

One preferred embodiment of the invention combines the set of the twelve pentomino pieces 10 to 21 as shown in FIG. 1 with certain marking combinations such as colour combination and physical dimensions as described further below. Each pentomino piece consists of five equal size squares or cubes connected in each of the twelve unique ways in which five (5) squares or cubes of the same size edge to edge can be combined. In addition, one of the five tetromino pieces 22 to 26 as shown in FIG. 2 is included in this combination. Each tetromino piece consists of four equal sized squares or cubes connected in each of the five unique ways in which four squares or cubes of the same size edge to edge can be combined.

The following discussion describes a preferred embodiment of the invention using 12 (twelve) pentominoes plus the addition of one tetromino piece of the five possible as shown in FIGS. 1 and 2 to form an eight by eight checkered patterned playing board. This board will be hereinafter referred to as the pentomino board.

The dimensions of each square is one unit x one unit for example 2 cm by 2 cm. The height of each pentomino may be a multiple of the square dimensions (1×, 2×, 3× etc) to serve a special function to be discussed further below. However, any arbitrary height may be used also if the special function properties are not required, including flat pieces, still retaining their functional integrity. Though the present embodiment covers tetromino pieces that have been separated into other ominoes as well as other polyominoes, the following discussion will discuss them in terms of the five intact physical forms of the tetromino pieces as shown in FIG. 2.

Figure 3:
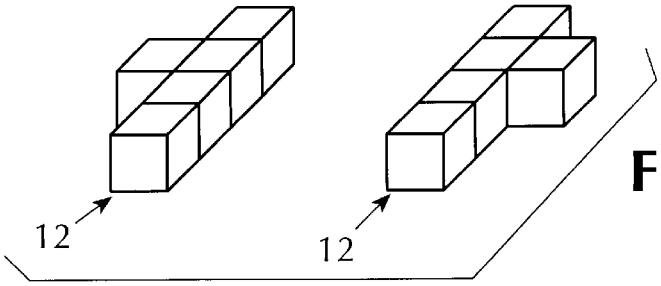
FIGS. 3 (*a*) and (*b*) illustrates a pair of non reversible pentomino pieces.

Six of the pentomino pieces and two of the tetromino pieces are of a non-reversible nature, that is, when turned over they show the mirror image of each other as illustrated by the pieces 12 in FIG. 3. This property is also of importance when colour patterns or other markings are taken into account. For convenience in understanding this embodiment of the invention, all pentomino pieces 10 to 22 are identified by an alphabet letter as regards the obverse or top side of the piece. Thus the pentomino pieces 10 to 22 are identified by the capital letters E,F,G,H,I,J,L,P,Q,R,S,T,U,V, W,X,Y and Z as shown in FIG. 4. The E/F, G/Y, H/R, J/L, P/Q, S/Z are the reverse or mirror images of the same piece (when turned over).

Similarly the tetromino pieces are identified by the small letters i,j,l,o,s,t and z as shown in Fig. S. The j/l and s/z pieces are the mirror images of the same piece (when turned over).

Any given set of pieces for the pentomino board is thus made up of the twelve unique pentomino pieces plus one of the unique tetromino pieces. FIG. 6 is one solution of the puzzle showing the assembled twelve pentomino pieces 10 to 21 and a square or "o" tetromino piece 22 which is shown shaded.

Figure 7I:
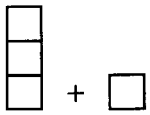
FIG. 7 (*i*) to (*v*) illustrate in plan view tetromino pieces broken up into one or more monomino units.
Figure 7:
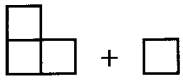
Figure 7:
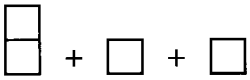
Figure 7V:
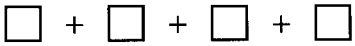

As stated above, single tetromino pieces may be broken up into smaller omino units without detracting from the principles of the invention. As an example, FIG. 7 (i) to (iv) shows the range of possibilities of pieces that could replace a single tetromino piece.

Figure 9:
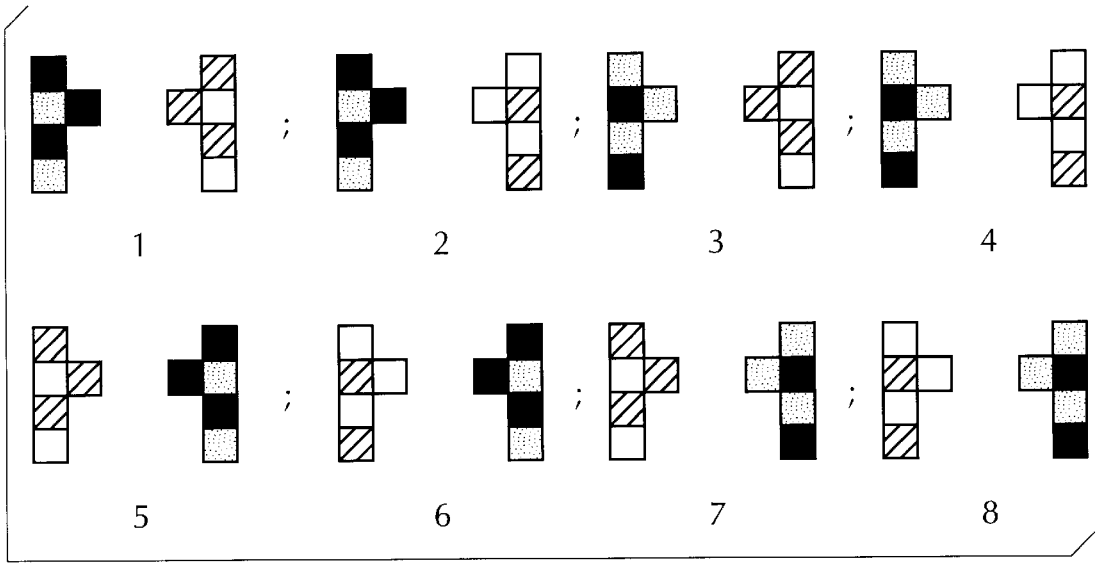
FIG. 9 illustrates in plan view the set of pentomino pieces of FIG. 8 with various choices of four marking combinations possible.
Figure 10:
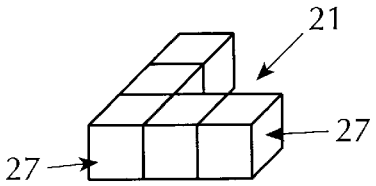
FIG. 10 illustrates in perspective view a pentomino piece as if composed of three dimensional cubes showing the side faces thereof.
Figure 18:
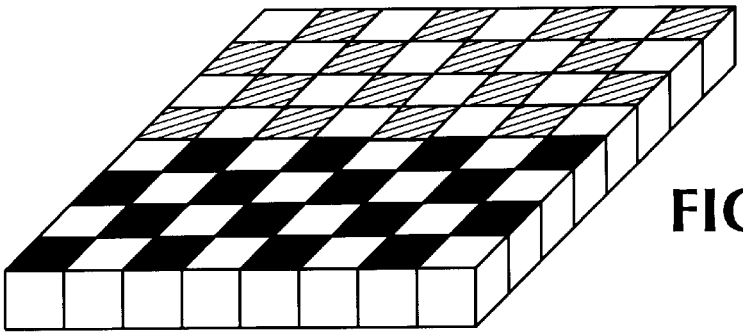
FIG. 18 illustrates a special feature half board formed with the pieces according to an embodiment of the present invention with three colour markings.

The following colouring mechanisms for the pentomino and tetromino pieces are examples of what is possible:

1. Both obverse and reverse surfaces of the pentomino and tetromino pieces are coloured or marked in an alternate pattern. Three colours or markings are to be used in total, involving one colour common to both obverse and reverse sides and one non common colour (on each side) as seen in FIG. 18, different colours being identified by different shadings.
2. Both obverse and reverse faces of the pentomino and the tetromino pieces are coloured or marked in an alternate pattern. Four colours or markings are to be used in total, two exclusive to either side (FIG. 9), the differing colours being again identified by different shadings.

Figure 11:
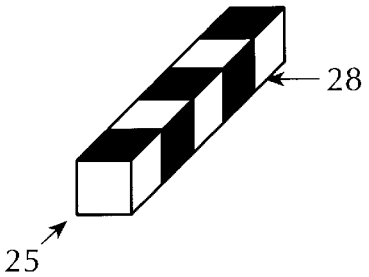
FIGS. 11 and 12 illustrate the "I" pentomino piece in single cube thickness with side markings and the "O" tetromino piece in double cube thickness, respectively.
Figure 12:
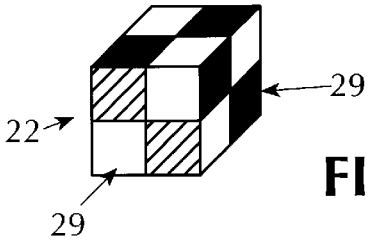

The sides of the pentomino pieces laterally of the obverse and reverse sides, for example the sides 27 of the pentomino piece 21 shown in FIG. 11 may also be marked or coloured arbitrarily or in an alternate pattern in a similar manner to the obverse or reverse faces. FIG. 11 shows an example of such marking comprising an "I" tetromino piece 25 where the sides 28 have an alternate checkered pattern. FIG. 12 illustrates the "O" tetromino piece 22 with checkered sides 29.

Figure 13:
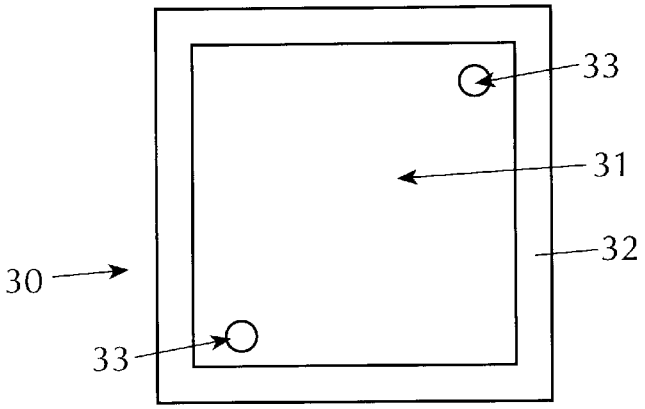
FIG. 13 is a plan view of a board with which the polyomino pieces may be used.
Figure 14:
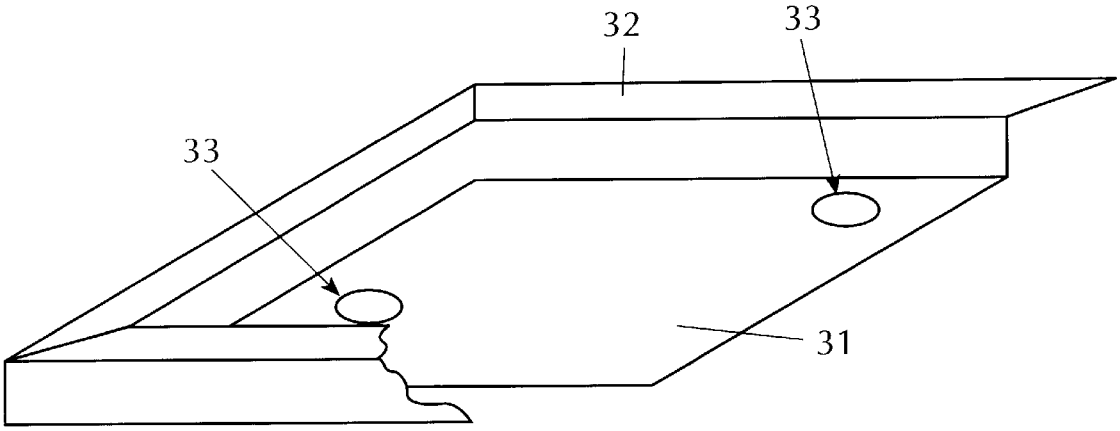
FIG. 14 is a cut away perspective view of the board of FIG. 1.
Figure 15:
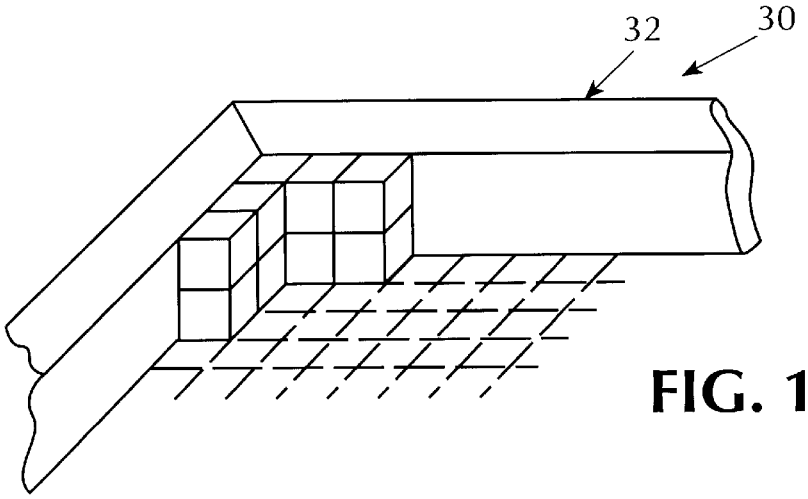
FIG. 15 is a cut-away view of a corner of the board showing a double cube playing piece in position.

Referring now to FIGS. 13 and 14 there is illustrated a board 30 for use with the polyomino pieces of the invention. The board 30 consists of a base 31 measuring eight by eight units, framed by a border 32 of any suitable height that will allow the pieces to sit firmly in position. For example, the height of either one length unit or two length units may be used to allow pieces to sit flush against the border 32 as shown in FIG. 15. This will facilitate the use of the finished puzzle as a chess board, for example and will also hide the sides of the playing pieces from view. To be able to easily remove pieces from the puzzle, a number of finger sized holes 33 may be provided in the base 31. Pieces are then easily pushed up from underneath using one's finger through a hole 33. Of course, any other way of providing an easy means removal of pieces from the board 30 through levers, magnetic forces or any other sophisticated mechanism may be provided. The base 31 and its border 32 may be constructed out of any suitable material such as cardboard, timber, metal or plastic. Similarly the pieces may be made out of the same materials.

The existence of the various boards is totally controlled by the selection of the pieces. Thus, for example the 13 (thirteen) "pentomino board" pieces should be suitably chosen according to the colour mechanisms as indicated above in order to give a known and fixed number of solutions. Thus, the thirteen pieces will be selected by taking one of each of the twelve pentominoes, viz the E/F, G/Y, H/R, J/L, P/Q, S/Z pieces and the X,I,W,T,V, C pieces as well as, in this case, one of the tetromino pieces i, j, l, o, s, t and z marked according to the colour mechanisms described above.

Figure 8:
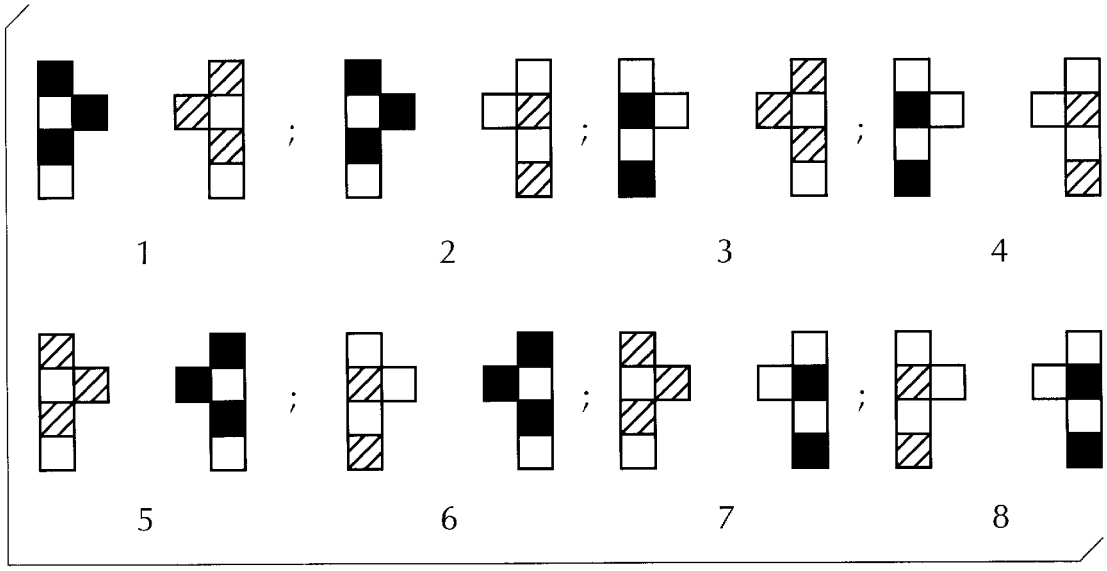
FIG. 8 illustrates in plan view one set of pentomino pieces with the various choices of three marking or colour combinations possible.

In other words, one is required to choose a G/Y piece for example according to the selected colour mechanism and then consider the options for that piece. If it is decided to choose a board displaying three colours the option would then be one of the eight pieces shown in FIG. 8.

Likewise the other pieces are selected. It will furthermore be possible to select pieces, such that "n" number of chess boards are possible in the colour of the obverse side of the puzzle and "m" number of solutions for reverse side of the puzzle. The situation which occurs when different solutions exist on both the obverse and reverse playing sides of a given set of pieces, that is where solutions obtained using the obverse sides only of the playing pieces and different from and cannot be obtained using the reverse sides of said pieces is referred to herein as a "lock".

Two seemingly identical puzzles can in fact be made up totally differently. This also means that two puzzles, both showing identical chess boards as in FIG. 16 may be made up from different selections of pieces allowing, for example, a dozen solutions on both sides in the first set but, for example, only one solution of both sides in the second set.

FIGS. 17 (*a*) and 17 (*b*) illustrate two checkered board solutions using opposite sides of the pieces. The pieces are marked on one side in one pair of markings, for example white and red (indicated as shaded), whilst on the opposite side the pieces are marked in another pair of markings, for example, black and white, white being common to each side.

With the pieces illustrated in this embodiment, it will be seen that the white squares correspond on both sides in the "W" and "T" pentomino pieces 17 and 19. Correspondence also occurs in the "i" tetromino 25 although this is not necessary as that piece can be reversed in orientation. In all other pieces, the colouring is reversed from one side to the other, that is the white square on one side is opposed by a "dark" (red or black) square on the opposite side.

In the present invention, there is no correspondence in all pieces of a puzzle between the markings on opposite sides. Nor in all pieces, are the markings reversed on opposite sides, that is for example, white on one side and black on the other.

A great attraction of this invention is the existence of the lock between obverse and reverse sides of the puzzle. It can be shown that the number of locks available runs into the millions. This then allows for individualised puzzles which could be made up through subtle changes in the piece selection. The full range of pieces form a set that will also encompass the total range of solutions that exist.

The above applies only to the principles involved in the mechanisms of colouring or marking the pieces, not the actual colours themselves. Nor does it take into account the actual geometric parameters of the pieces, such as the overall size or height, nor the colouring of the sides of the pieces. Although the appearance of the finished puzzle in the frame may be the same, the challenge to find solutions will remain as one proceeds from one puzzle to the next.

It is not possible to learn the solutions of one "locked" puzzle and apply those solutions to another "locked" puzzle. It simply will not work. Through the mechanism of locks it will also be possible to determine the difficulty of the puzzles. It will be possible to select a set where, for example, some 100 plus checkered board solutions are possible as well as sets where there is just one solution. Through the same mechanism it is also possible to assemble boards other than straight checkered boards.

The following "polyomino boards" can be assembled using appropriately chosen sets for the purposes of illustrating the concepts of the invention discussed above. All special feature boards described below may be assembled to form solutions on each side of coherent checkered board patterns of light/dark alternate markings as described above.

1. Half-Boards

Figure 19:
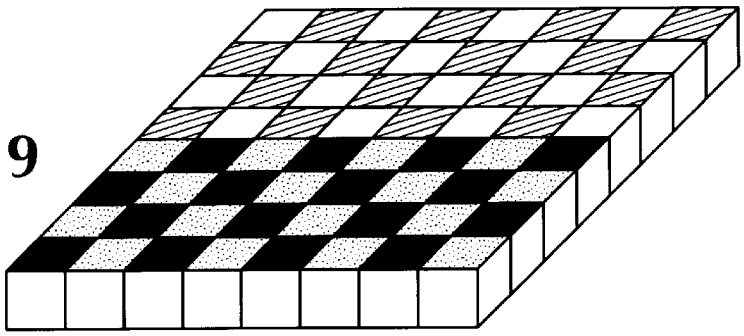
FIG. 19 illustrates a further special form of half board with four colour markings.

A half-board feature can be formed using suitably selected polyomino pieces. A half board comprises a checkered board where half of the board will show the colours or markings of the obverse side and the other half of the board the colours or markings of the reverse Bide of the puzzle. FIG. 18 shows such a half-board with, for example the markings black/white on one side and red/white on the other side indicated by different shadings. Under certain circumstances it may also be possible to create half-boards using four colour or marking combinations or shadings as shown in FIG. 19 using special aspects of the invention described further below. Again the number of boards in existence is determined by the particular lock.

2. Chess Boards

Figure 20:
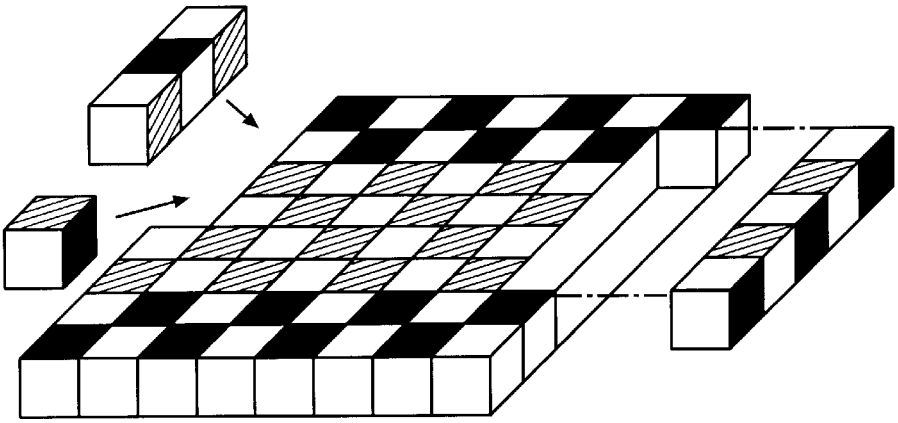
FIG. 20 illustrates a special feature chess board formed in accordance with the invention.

A board is identified as a chess board with rows 1, 2 and 7, 8 in the colours of the obverse side of the puzzle and rows 3, 4, 5 and 6 in the colours of the reverse side of the puzzle or vice versa. These features when developed out of "pentomino boards" are rare and will constitute a hard challenge to find. FIG. 20 shows an example of such a board.

3. Checker Boards

Figure 21:
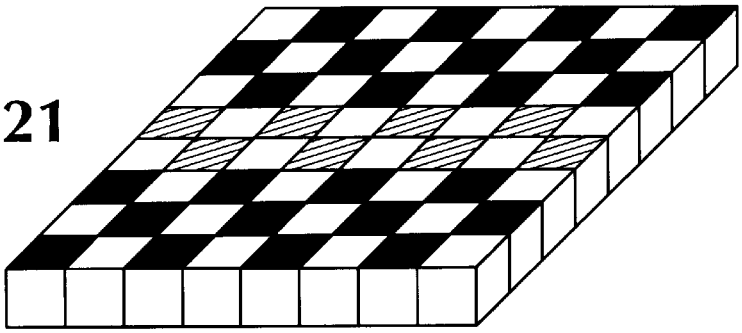
FIG. 21 illustrates a special feature checkerboard formed in accordance with the present invention.

A polyomino board is identified with a checker board feature when rows 1, 2 and 3 and 6, 7 and 8 are in the colours of the obverse side of the puzzle and rows 4 and 5 in the colours of reverse side of the puzzle or vice versa. An example is shown in FIG. 21.

4. Initialised Boards

Figure 22:
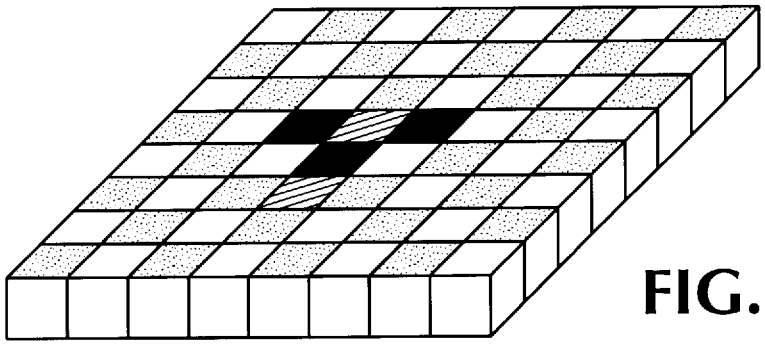
FIGS. 22 illustrates a four colour board which defines the shape of a particular letter.
Figure 23:
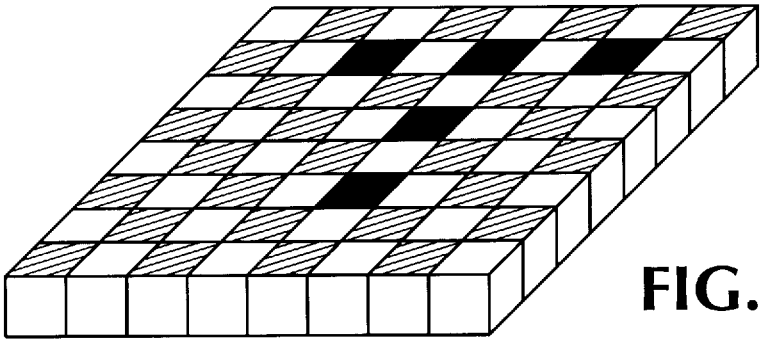
FIGS. 23 illustrates a three colour board which defines the shape of a further letter.

These "pentomino boards" are selected especially to show a desired initial (or two). The initial is revealed by turning one (or two) pieces over in an otherwise perfectly checkered solution. FIG. 22 shows an example where the letter T is formed in a four coloured board (indicated by different shadings) by the turning of the "T" piece (a) or in a three coloured board, by turning the "I" piece together with the "i" piece (b) (FIG. 23).

5. Special Challenges

Figure 24:
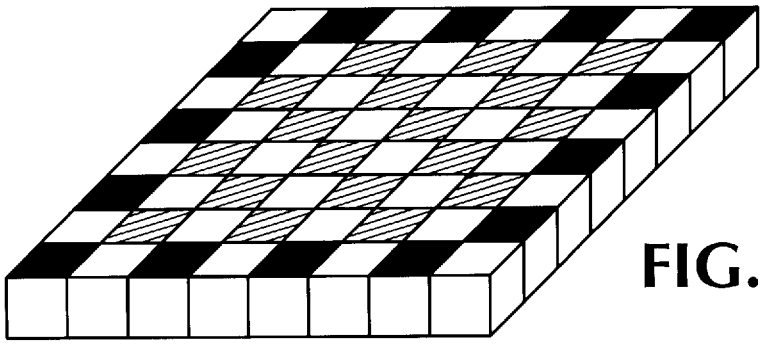
FIG. 24 illustrates pentomino pieces arranged to form a "frame" board.
Figure 25A:
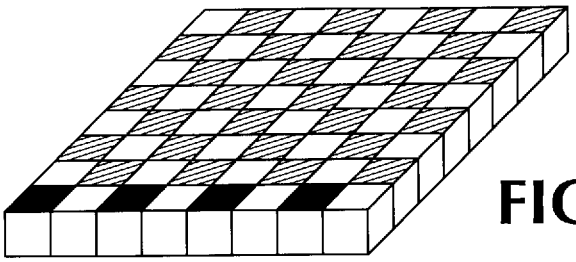
FIGS. 25 (*a*) to (*d*) illustrate respective solutions of a special feature puzzle termed a "Rising Sea" puzzle.
Figure 25B:
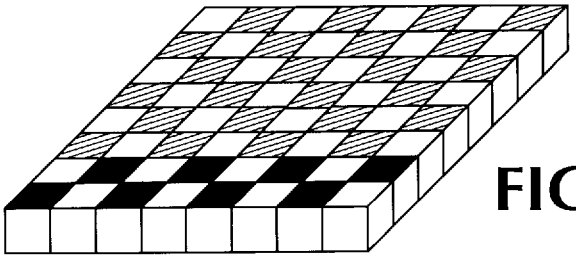
Figure 25C:
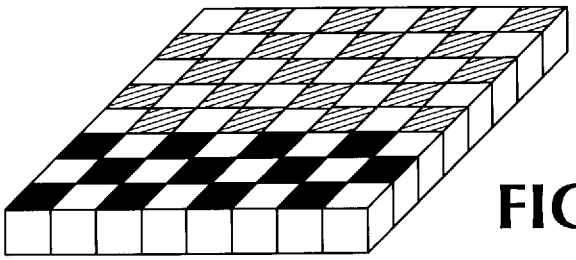
Figure 25D:
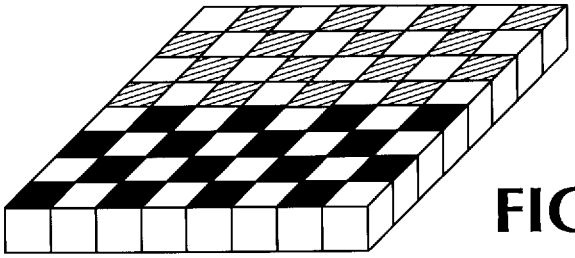

A further configuration of board 15 shown in FIG. 24 which comprises a board in the form of picture frame where alternately marked squares define a border around the checkerboard of different colours from the markings within the border.

FIGS. 25 (*a*) to (*d*) illustrate a board termed the Rising Sea Board where all four solutions illustrated are found using the same 13 (thirteen) pieces. As shown, respective pieces are turned over to display the checkered pattern of the reverse side in the first, second, third and fourth rows respectively. This type of board is rare and only possible for few "pentomino board" locks. Many more special challenges exist. The two presented above only serve as an example.

One of the important aspects of this invention is therefore that an incredibly high variety of puzzles can be supplied, all with different types as well as numbers of solutions. All these puzzles will have their own particular "lock" that will make them uniquely different from one another. Yet all puzzles are made from a very small stock of basic elements. All the three and four colour boards may be assembled into checkered board patterns of two colours using opposite sides of the pieces. These may be made with or without height or side colouring specifications.

Depending on the particular choice of the "pentomino board" pieces it may also be possible to combine some of the above solutions in one puzzle. For example it is possible to combine a three coloured Rising Sea Board with a certain three coloured Half-Board as well as two different two coloured uniform checkered boards, (e.g. black and white and blue and white) all in the same puzzle and with a lock. In all boards, at least one checker board solution (and usually more than one) will exist on both sides unless specified otherwise. This will enable the set to always form the foundation for a chess or draughts game or other game using a checker board.

In particular form of the invention, the pieces comprise the set of pentomino pieces as previously described of cube thickness with in this case the tetromino piece of cube thickness being replaced by a straight tromino piece and a monomino piece of similar thickness. The straight tetromino and pentomino pieces and monomino pieces have their lateral sides marked or coloured in the colours of the obverse and reverse sides. This allows in addition to two marking checkered solutions on both sides, a chess board solution of the type shown in FIG. 20 by rolling the tetromino, monomino and pentomino pieces to expose the markings shown on their sides.

Figure 26A:
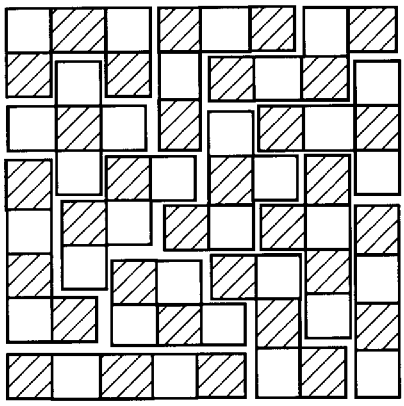
FIG. 26 (*a*) and (*b*) illustrates a three colour board with a checkerboard solution for the obverse side and a different solution necessary for the reverse side to be assembled as a checkered board.
Figure 26B:
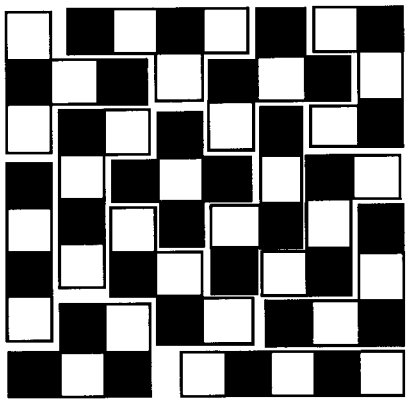

Referring now to FIGS. 26 (*a*) and (*b*) there is illustrated solutions using pentomino pieces forming a checkered board patterns on the obverse and reverse sides respectively. The pieces on one side have their squares alternately coloured, for example red and white, the colour red being indicated by the shading whilst on the reverse side, the pieces are coloured alternately in different colours, for example black and white.

Figure 27A:
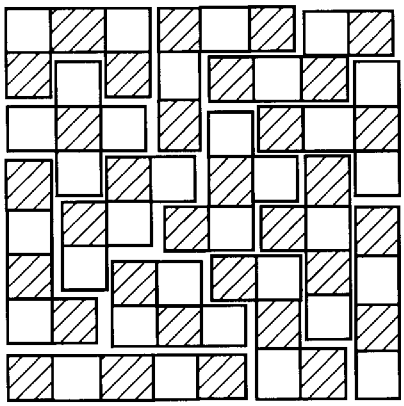
FIGS. 27 (*a*) and (*b*) illustrate the three colour board in which the colours on the reverse side have been switched from that of FIG. 26.
Figure 27B:
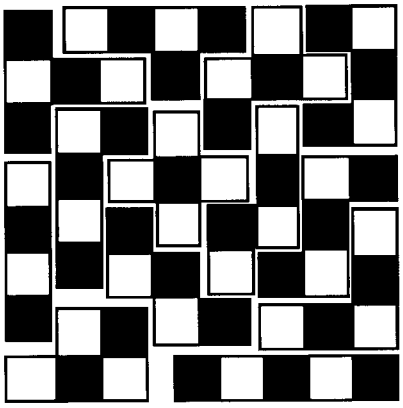
Figure 28A:
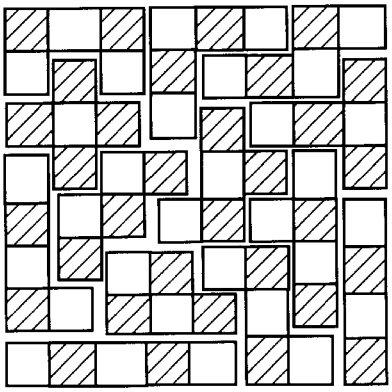
FIGS. 28 (*a*) and (*b*) illustrate the three colour board with both colours of the obverse and reverse switched from that of FIG. 26.
Figure 28B:
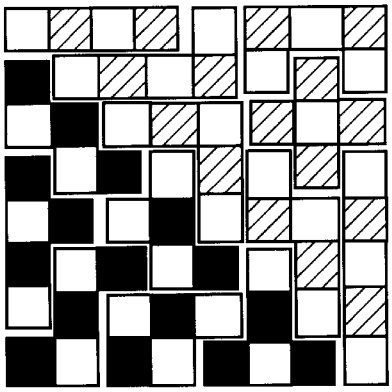
Figure 28C:
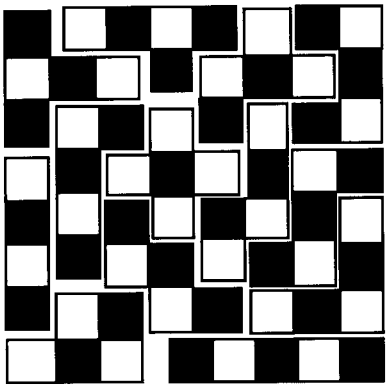

As illustrated, the pieces may be assembled to form on the obverse side a checkered board pattern comprising red and white as in FIG. 26 (*a*), whilst the pieces may also be assembled on their reveres side as in FIG. 26 (*b*) to form a checkered board pattern of black and white. Subtle changes in the colour selection will serve to illustrate the different natures of seemingly like puzzles. It may thus be possible to have puzzles in the mentioned colours and with fixed numbers of solutions on either side that are different. If it is imagined that on one side of the puzzle (say the reverse black/white side), the colours swap places (that is the black now becomes white and white now becomes black), whilst no changes occur on the obverse side as in FIG. 27 (*a*) and FIG. 27 (*b*), only the two solutions illustrated will exist and no half boards or diagonal boards will be possible. Further switching of the colours however, may enable the construction of certain types of half boards or diagonal boards or other types of boards which were not possible in the first two options. Thus, this makes for intrinsically different boards even though the obverse side and reverse side colour schemes have the same solution. For example, in FIG. 28 (*a*), the red and white colours have been switched from that of FIGS. 26 (*a*) and 27 (*a*) whilst on the opposite sides, the pieces have the switched black and white colours referred to in FIG. 27 (*b*). These pieces may be assembled to form the board of FIG. 28 (*c*) showing a diagonal feature which separates the different checkerboard colours diagonally of the board.

Figure 29A:
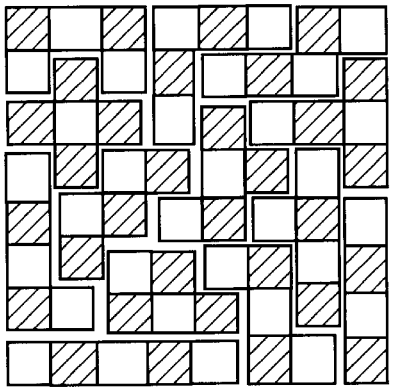
FIG. 29 illustrates a solution composed of the pieces with the colour combination of FIGS. 28 (*a*) and 26 (*b*) not possible with the colour combination of FIGS. 26, 27 and 28.
Figure 29B:
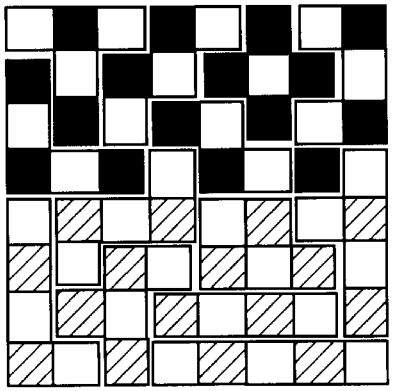
Figure 29C:
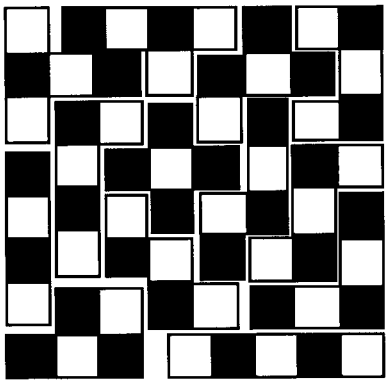

In FIG. 29(*b*), the black/white colours are again switched back to those of FIG. 26(*b*) which enables construction of the half board of FIG. 29(*c*) comprising two colours on one half of the board and two colours on the other half of the board, one colour being common. This element allows "super locks" which have three key solutions—obverse, reverse and feature instead of the usual two.

Figure 30:
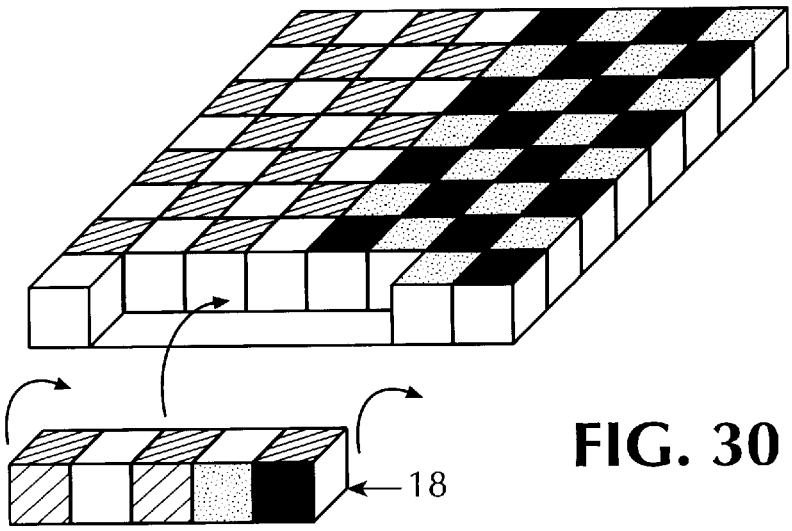
FIG. 30 illustrates a checker board with an associated rotatable "I" piece using the three dimensional cube format.

An extra level of difficulty as well as fascination is added by allowing an extra degree of freedom by making use of the three-dimensionality of the pieces. The first level of this is found in any set where the height of the pieces indicated as "h" in FIG. 1 is set equal to the linear dimension of each square. Likewise the height of the frame 32 surrounding the board 31 will assume the same value. It thus becomes possible to rotate (roll) the "I" piece 18 making it possible to use the four sides of the piece instead of only the top and bottom sides. Thus if the lateral sides of the "I" piece are coloured in another suitable checkered pattern it may then allow for additional solutions that previously did not exist. (This only pertains to half-boards or any board where a mixture of the colours of obverse side and reverse side occurs). FIG. 11 shows an example of an "I" piece where the lateral side has been coloured inconspicuously. A more obvious change to the pattern may be seen in FIG. 30, where the "I" piece 18 could be used and rotated to make the solution of FIG. 19.

This principle may also be applied to three marking or colour boards of the type for example shown in FIG. 20 where pieces may have their lateral sides marked in squares with the markings of the obverse and reverse sides. In FIG. 20, the pentomino piece 18 has the squares on its lateral sides marked in a chequered pattern with one of the set of markings on the obverse or reverse sides of the pieces. Additionally, the tetromino piece used in this solution is broken into a straight trionomo piece and monomino piece, both of which have their sides marked with the markings of the obverse or reverse sides.

By using such a mechanism, it has been found possible in solutions having three markings or colours, such as the half board of FIG. 18, the chess board of FIG. 20, the checkers board of FIG. 21, and the frame board of FIG. 24, to recreate the same patterns or features but with the non-common markings or colours swapped. For example in the chess board of FIG. 20, the pieces may be rearranged such that squares shown in black are swapped with the squares shown in cross hatching. This may be achieved by reversing some or all of the pieces and rearranging the pieces. All of the pieces may not required to be reversed in position in order to swap colours for such feature patterns.

Figure 31:
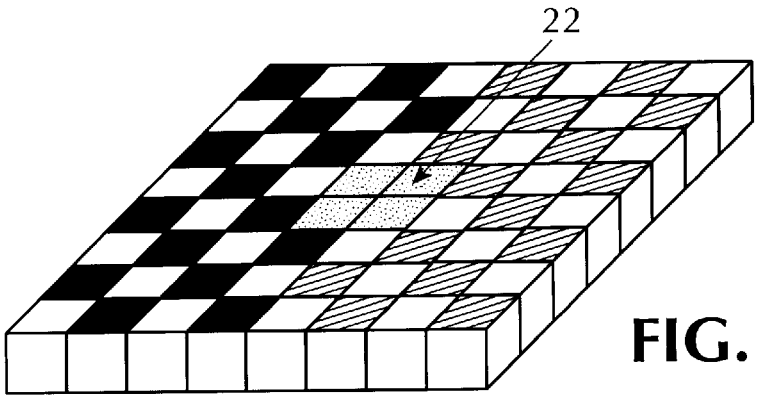
FIGS. 31 and 32 illustrate a checkered board incorporating a rotatable "o" tetromino using the three dimensional double cube thickness format.
Figure 32:
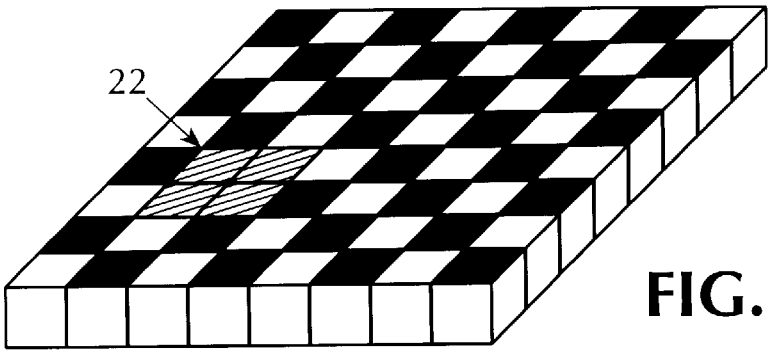

A second level is found by choosing the height of the pieces as well as the frame to be twice the linear dimension of the square. In this case, the "o" piece assumes the shape of a cube as shown in FIG. 12. Since the cube has six equal faces it allows for four additional faces to be coloured or marked as desired. Additional faces may show a mixture of the colours of obverse and reverse sides, while other faces may show a totally different colour or alternatively advertising or some other message. It is clear that the cube may then serve a similar role as the "I" previously in making up a solution similar to the one of FIG. 19. It also opens up another aspect to the chess board. FIGS. 31 and 32 show two examples of a chess board where the cube piece 22 has been turned over to reveal a different face instead of the checkered face required to make the standard solution. One example of a board offered by this invention could be called a Roaming Squares Chess board and could also include a modification of the rules of chess as described further below.

Figure 33:
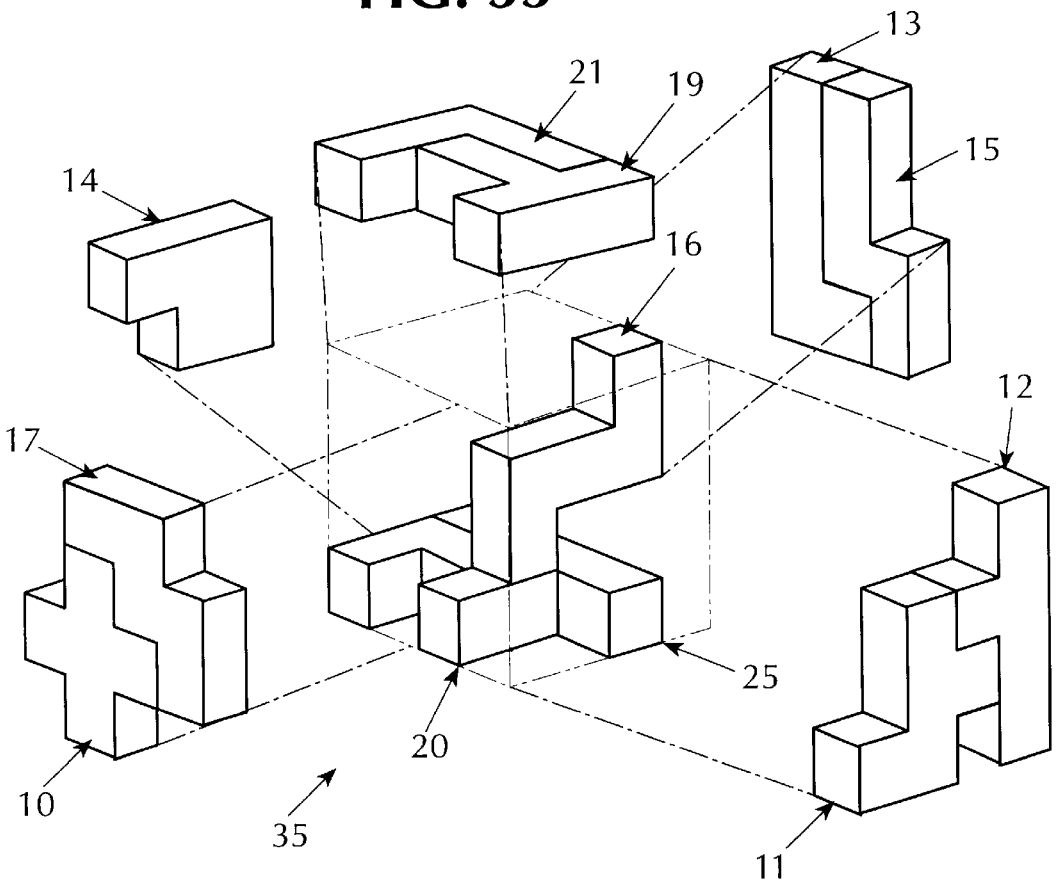
FIG. 33 illustrates in exploded view, the puzzle pieces arranged to form a four by four by four cube.
Figure 34:
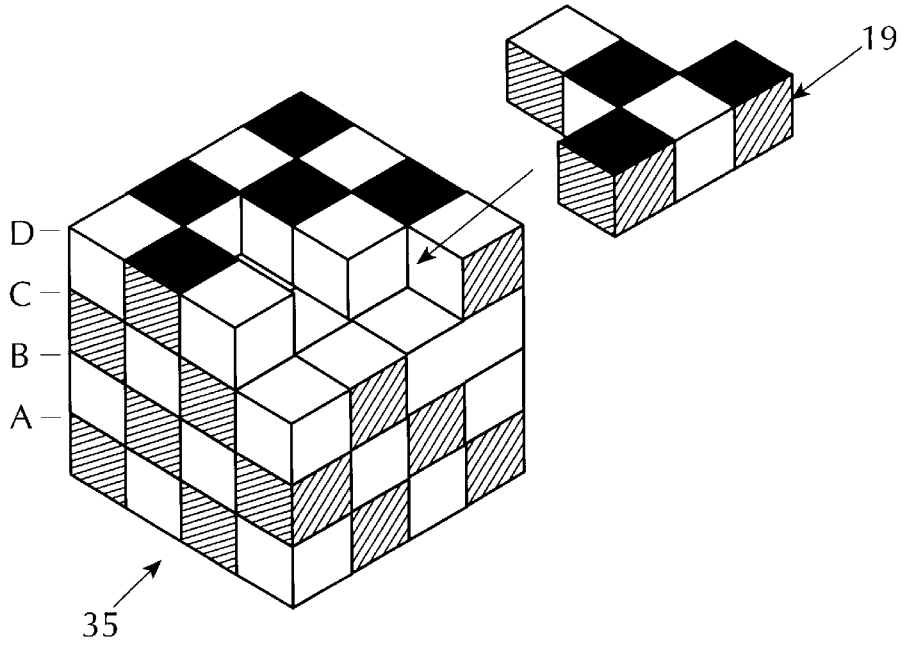
FIG. 34 illustrates the cube formed with the puzzle pieces of the invention with one piece removed with the side faces coloured or marked in accordance with the set pattern.
Figure 35A:
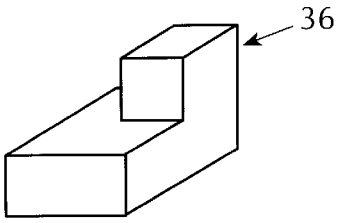
FIG. 35 (*a*) and (*b*) illustrate schematically configurations of the hollow within the formed cube.
Figure 35B:
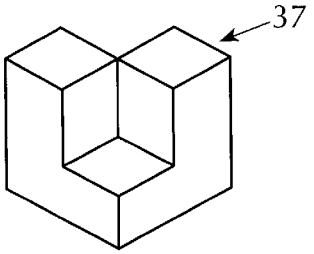
Figure 36A:
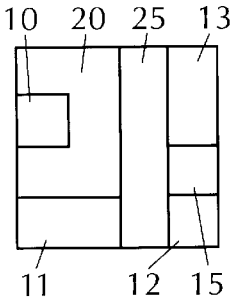
FIG. 36 (*a*), (*b*), (*c*) and (*d*) illustrate the puzzle pieces present in the cube FIG. 34 at the levels A, B, C, and D.
Figure 36B:
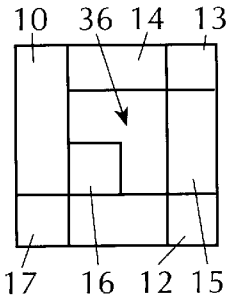
Figure 36C:
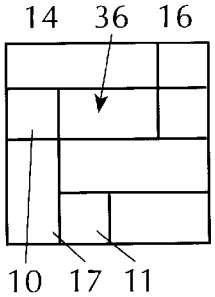
Figure 36D:
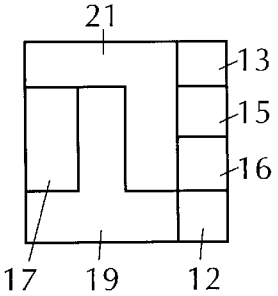

As a consequence of the three dimensional character of the pieces, it is also be possible to use the pieces in a three dimensional construction as opposed to a flat board. Thus, the pieces may be used as building blocks to form various constructions, as for example a cube 35 consisting of four by four by four units as shown in FIGS. 33 and 34. As the thirteen pentomino pieces include one piece of a dimension five by one (the "I" piece 18 of FIG. 1), this piece can obviously not be included in such a cube 35 comprising four by four by four squares. It will be possible to construct cubes out of the remaining twelve pieces, however, if the five unit piece is simply replaced by an imaginary hollow space 36 in the middle of the cube (also consisting of five unit squares) as for example, of the shapes shown in FIG. 35(*a*) and (*b*). The position of the hollow space 36 or 37 and the respective pieces of the cube 35 are shown at each layer in FIGS. 36 (*a*), (*b*), (*c*), and (*d*). Furthermore, it is possible to construct cubes that form perfectly checkered or unicoloured patterns on all six faces. The colours of the faces may be chosen such that any set can be achieved. For example, a certain set containing black/white on one side with red/white on the other side can be used to make cubes that are totally black/white on all six faces or totally red/white on all six faces with any option in between. To achieve this final result, the lateral sides of the pieces are required to be coloured in a checkered pattern as for example in the piece 19 in FIG. 34. Whilst straightforward in construction, solving these will prove very challenging.

Figure 37A:
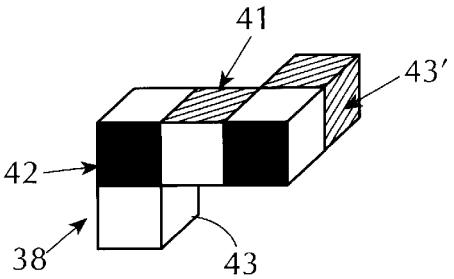
FIG. 37 (*a*), (*b*) and (*c*) illustrate typical three dimensional pieces which may be used to form a cube.
Figure 37B:
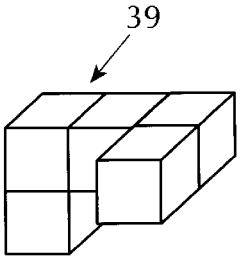
Figure 37C:
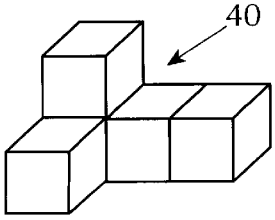
Figure 38:
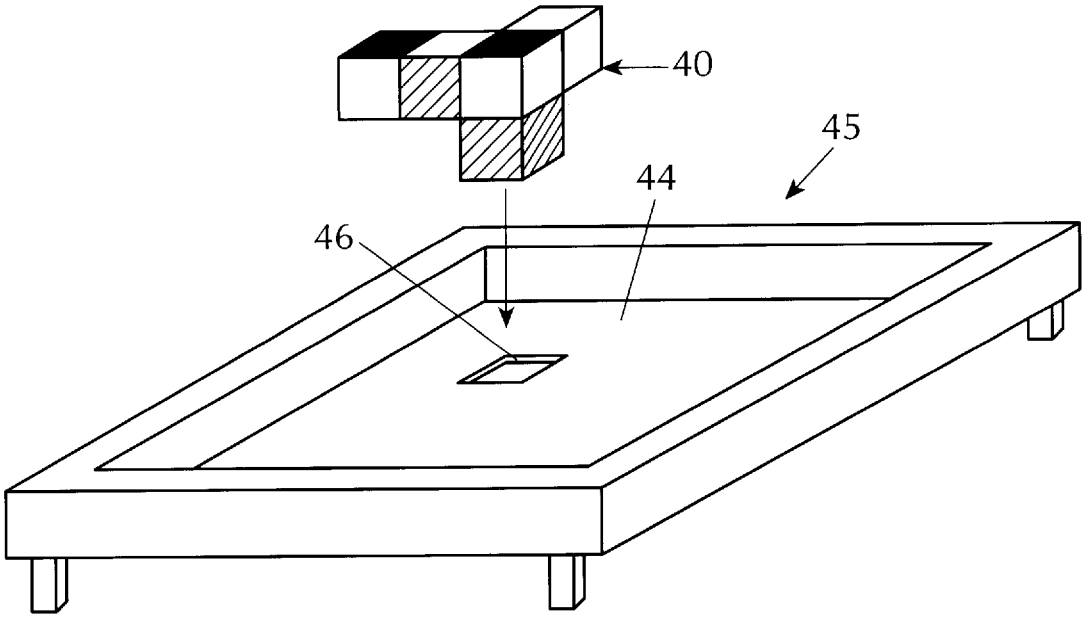
FIG. 38 illustrates a form of puzzle board base for use with the pieces of FIG. 37.

In a similar manner, solid cubes can be constructed if the five by one piece is replaced by one of an additional dummy three dimensional piece of the type shown in FIG. 37(*a*), (*b*) or (*c*). Each piece 38, 39 and 40 forms a tetromino piece 26 which is checkered on adjacent sides as at 41 and 42 in the piece 38 so as to enable it to be used for solving the basic flat checkerboard pattern on both sides. When the piece 38 is used as a tetromino piece 26 with the side 41 or 42 uppermost, that piece 26 has a protruding unit 43 or 43'. Thus with the face 42 facing upwards, the unit 43' will be protruding downwardly. Alternatively, if the face 41 is up, the protruding unit 43 extends downwardly. To accommodate the protruding unit 43 or 43', the base 44 of the games board 45 is provided with one or more apertures 46 to accept the protruding unit 43 or 43' as shown in FIG. 38.

An additional side effect will be that with the aid of this dummy piece, new flat board solutions may be created. In effect, the flat boards can now be constructed using either the tetromino piece or the dummy piece as a matter of choice together with the twelve pentomino pieces. Two sets of pieces put together would allow a five by five by five unit cube to be constructed using all pentomino pieces and either one or no tetromino pieces. The hollow in the middle would still consist of either one or five square units hidden inside the cube. There are also construction possibilities in a three dimensional sense using flat board pieces of thickness equal to two units (or more) with perfectly checkered faces.

Figure 39:
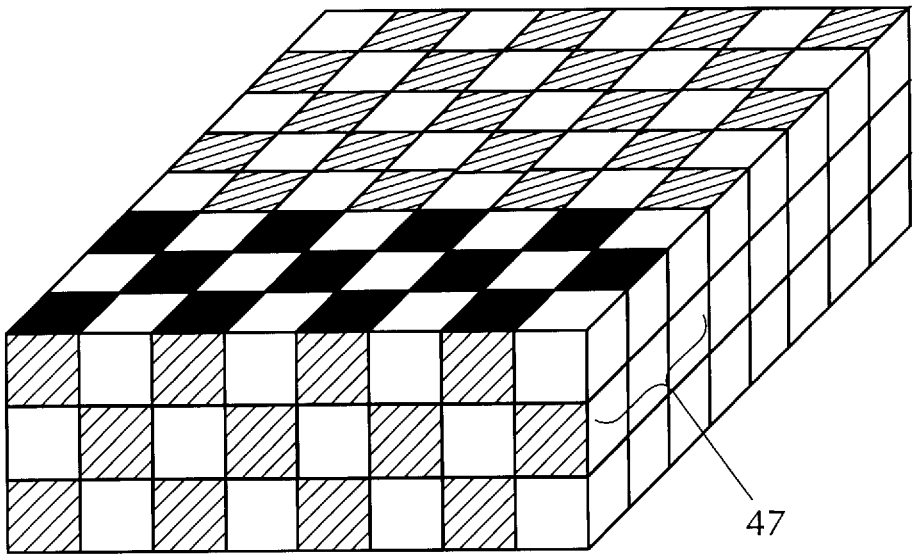
FIG. 39 illustrates a polyomino puzzle using pieces of three units in height, a whole section of which may be rotated.

A third level is found by tripling the height of the thirteen pieces and frame in relation to the linear dimension of the square. This could then give rise to the rotation of a whole block of pieces indicated at 47 such as that shown in FIG. 39.

Levels four to eight are also possible to construct. In all puzzles where either the "I" or the "o" or any other piece or combination of pieces are involved in a rotation it is suggested that the sides of all pieces be coloured in a checker board manner so as to camouflage the function of the pieces that play a role in rotations.

Thus, the boards of the invention may be constructed first as a puzzle in a checkered board pattern and then be used as a board to play the standard games of chess or checkers.

A first aspect of the puzzle is the personal challenge to the individual to find any possible way of returning the pieces to the recessed area regardless of pattern or colour. This comprises the first relatively easy level.

In the second aspect, one may attempt to place polyomino pieces with the correct colour side up but without paying attention to a checkered pattern. This is a moderately difficult level in most cases.

A third aspect is to return the thirteen polyomino pieces to the playing board in any non-uniform checkered board pattern where the colours of the obverse side and reverse sides are mixed, but where light and dark are still in an organised checkered board pattern. This again is a moderately difficult level in most cases.

A fourth aspect is to find a checkered board with uniform colouring of the obverse side of the puzzle or alternatively on the reverse side of the puzzle. This constitutes a very difficult level. A clue however is the fact that the colour choice of the uniform colouring is given for all pieces.

Other aspects arise where polyomino half-boards or other boards are known to exist. Where half-boards do exist on "pentomino boards" they are extremely difficult to find. This is largely due to the fact that a given piece may need to be used in the reverse side colouration, no clue being available.

Other aspects relate to "flippable" or "twistable" pentomino configurations that may be comprised of two or more pieces that can be turned over without altering the configurations such as a five by five square or three by five rectangle. These are also entertaining and may be very easy to extremely difficult to find.

All of the above challenges could be either measured or turned into a game by timing, or else competing with an opponent. One could challenge another participant or both could accept a similar challenge against a time clock.

Figure 40A:
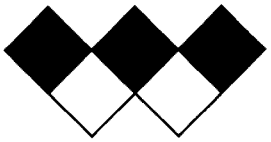
FIG. 40 (*a*) (*b*) and (*c*) illustrate a particular pentomino piece arranged to represent the letters W, M and E respectively.
Figure 40B:
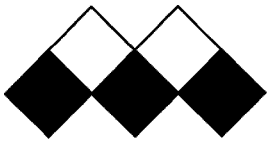
Figure 40C:
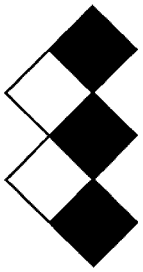
Figure 41:
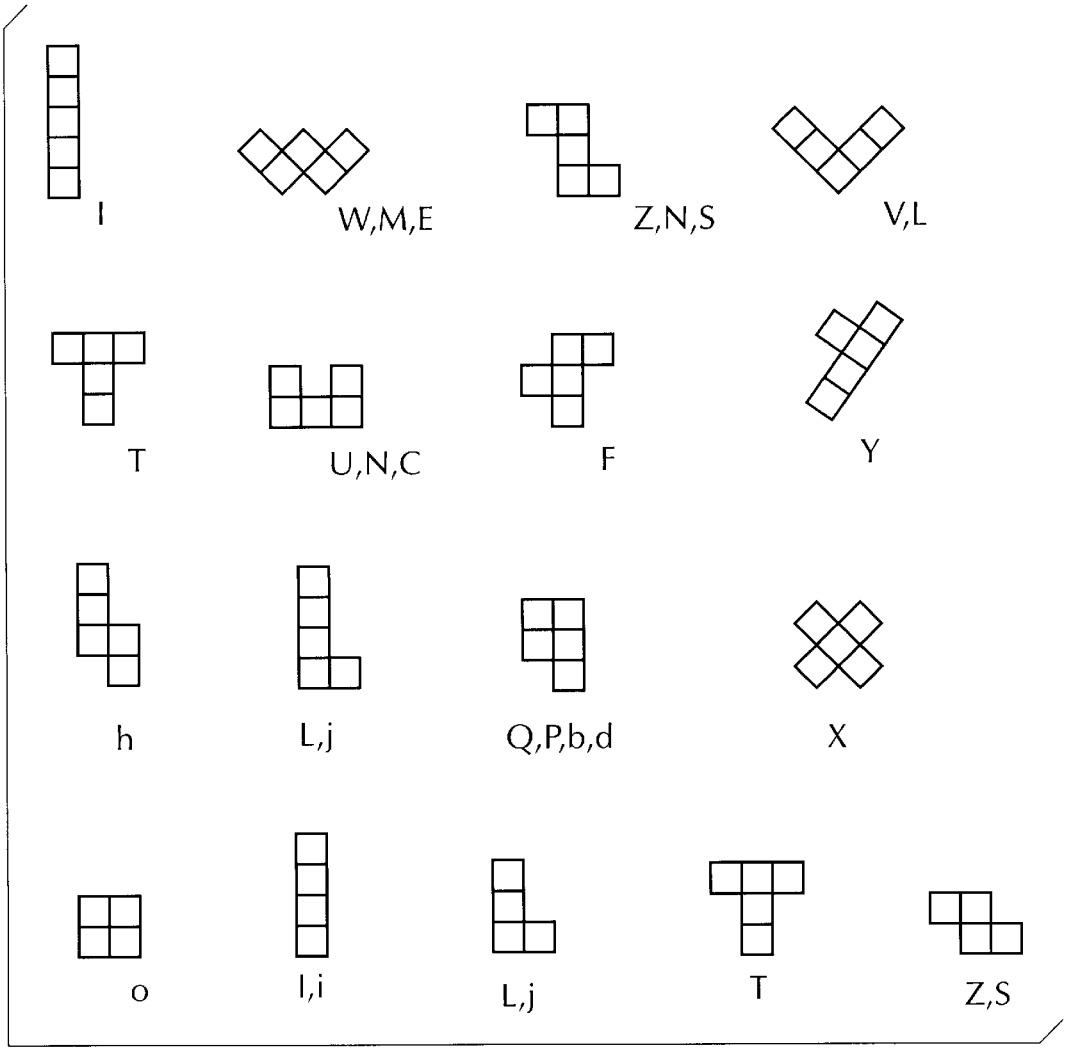
FIG. 41 illustrates a set of pentomino and tetromino pieces indicating letters of the alphabet.

A second entertainment dimension covers the application of the pieces of this puzzle to a word game. The pieces of the puzzle have already been identified by letters as in FIGS. 4 and 5, but for the purposes of this game the pieces are arranged to give rise to a representation of letters. The piece identified previously by the letter W may now represent other letters of the alphabet. Thus, the W piece may also adopt the letters M or E (FIG. 40) depending on how one wishes to view the piece. FIG. 41 gives a more total overview of the use of the pieces in this way, representing letters of the alphabet, however, this is not meant to be a limiting representation. Other choices may be possible.

Figure 42:
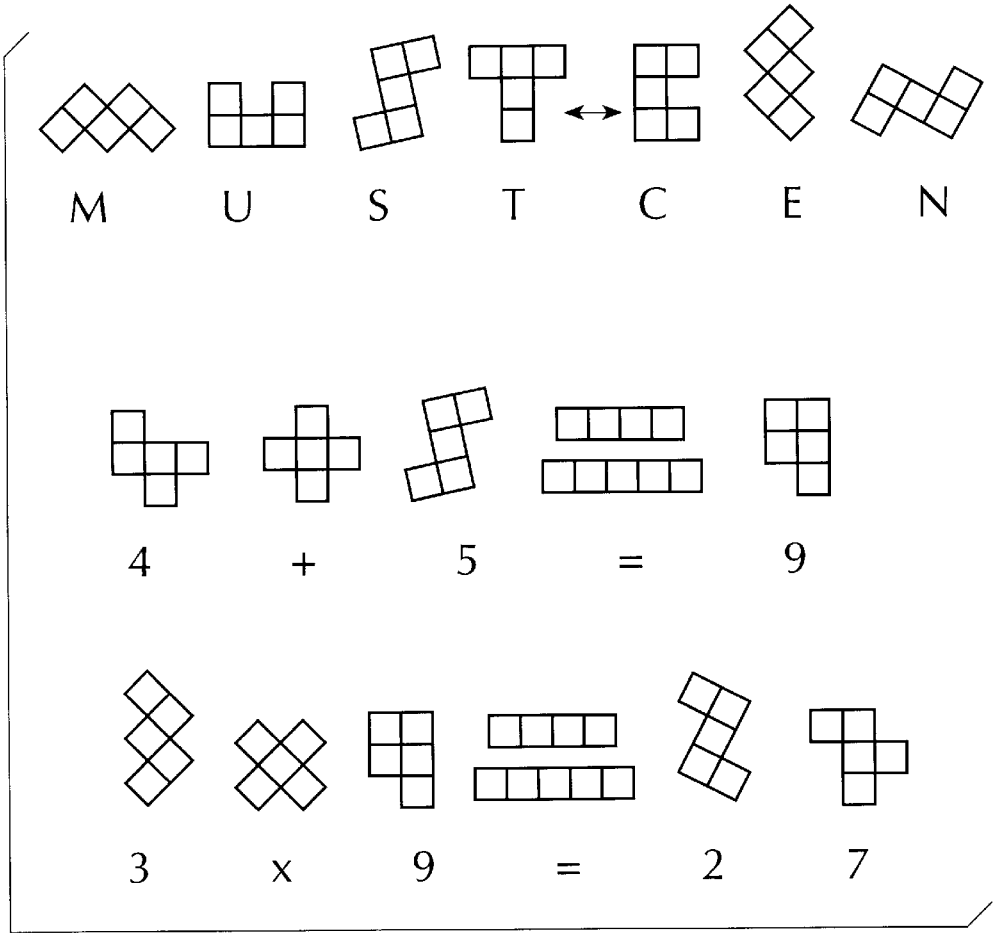
FIG. 42 illustrates the creation of two words from the same puzzle pieces.

In this aspect, the puzzle pieces may be used in a game where participants are asked to make up words from one or more shown sets (or even a subset) of the pieces, Similarly the game may ask to form words or anagrams out of any number of pieces. FIG. 42 shows a possible scenario for the words "must" and "cent" using the pieces identified by W, U, S, and T. To increase the difficulty of the game, the words sought could have minimum limits on the number of letters used, e.g. five or more letters for each word. A further game could consist of using all the letters [ie. thirteen or twenty-six—one or two sets] to form sentences. In a similar way the pieces may represent numbers instead of letters as shown by way of example in FIG. 43. Not only could this invention be an interesting game, it could also be a tool for psychologists in connection with testing of individuals, for spatial, verbal and memory capabilities.

Some puzzles can be put together to show special aspects of some of the chess boards or checker boards. The partitioning of the boards serves to indicate the starting positions of the chess pieces (draught pieces) and the battlefield. Chess or checkers may also be played on any half-board feature where, for example, the territorial impression is created of "my half versus your half" as for example shown in FIGS. 20 and 21.

The Roaming Squares Chess board is one of a number of specialised chess boards envisaged. While all standard rules of chess remain the same, the roaming square could now serve as a non-attack zone (with the exception of the King). Pieces positioned on the square (irrespective of the location of the square) would therefore be in a safe haven and could not be captured until moved off the square. This feature would also be relevant to the use of the six reversible pieces (I,T,U,V,W and X). When these pieces are turned over, they could also create or constitute a non attack zone (as long as they were synchronised for colour on both sides).

The present invention may also be adapted for use with computers. Thus, all the pieces along with their physical parameters (size and colour) may be represented by any computer simulation program. The present invention is thus extended to encompass any representation of all of the described aspects of this puzzle in any computerised form. In this form, the puzzle may be represented two dimensionally, such that the solutions appear f or example as shown in FIG. 26(*a*) on a video screen. Reversal of the images of the pieces as displayed and reassembly of the pieces will enable the result shown in FIG. 26(*b*) to be achieved. Alternatively, the image on the video screen may show the pieces depicted in the manner of FIGS. 17(*a*) and 17(*b*). Movement of the images of each piece about the screen to enable assembly may be achieved in any suitable manner known in the art, f or example by movement of a screen pointer under the control of a mouse.

The present invention may also be applied to psychology. In the past, a number of psychological aspects such as intelligence, memory, creativity, persistence and personality has been tested by using Koh's Block test from the WAIS-R and WISC-R intelligence tests which involves a basic block puzzle. The puzzle elements of the present invention provide substantially extension to tests of the above type. An example of a psychological test using pentominoes could look at forming words out of the letters with increasing degrees of difficulty, where each level would be timed from one minute at the easiest level to ten minutes at the most difficult level eg:

1. Words formed using two letters : 1 minute
2. Words formed using three letters : 2 minute
3. words formed using four letters : 2 minutes
4. Words formed using five letters 3 minutes
5. Words formed using six letters 8 minutes
6. Complete sentences : 15 minutes A second aspect would cover spatial intelligence and could look at creating:

1. Number of two piece congruencies : 2 minutes
2. Three piece rectangles (five×three) 3 minutes
3. Four piece rectangles (five×four) : 5 minutes
4. Five piece squares (five×five) : 7 minutes
5. Six piece rectangles (five×six) : 10 minutes
6. Seven×seven squares : 15 minutes
7. Eight×eight squares (using all the pieces) : 2 hours
8. Eight×eight checkered board : 10 hours The latter levels, because of the time involved, may be used less frequently. At all levels the number of solutions found within the time frame would be relevant.

A third aspect would investigate memory which would include, for example, recall after five seconds and again after thirty minutes of exposure to various configurations of polyomino pieces. Alternative polyomino forms would be available and hence one could avoid a number of test/retest weaknesses.

Another useful aspect of the puzzle is the educational value it represents. Since polyominoes such as pentominoes and tetrominoes belong to the branch of mathematics that deals with combinatorial geometry, the puzzle lends itself ideally to exploration and enlightenment in this field. This particular field of mathematics is very complex and has not been covered well by mathematical equations. For example, no equation exists (to date) to even predict the number N of polyominoes. (N-5 for tetrominoes and N-12 for pentominoes as seen earlier). Logical deductions, however, will provide certain answers and it is this aspect of the puzzle that may also be helpful to those areas in psychology where people may be tested, among other things, for their powers of deduction.

We claim:

1. A puzzle comprising a plurality of polyomino pieces, each said piece having on opposite sides one or more squares, said squares in each said piece and on said opposite sides having markings such that said pieces are capable of being assembled using their obverse sides only into one or more solutions comprising squares with the markings of the squares on said obverse side of said assembled pieces forming a checkerboard pattern of two alternating markings which may be used for playing a checkers or chess type game, and wherein said pieces may be further assembled using their reverse sides only into one or more solutions comprising squares forming a further checkerboard pattern of two alternating markings, said markings of said squares in total on both sides of said pieces comprise three or more different markings and wherein the assembly of pieces forming said solutions obtained using the obverse sides of said pieces is different from the assembly of pieces forming the said solutions obtained using the reverse sides of said pieces.

2. A puzzle according to claim 1 wherein said markings comprise three different markings and wherein only one marking is common to both sides of said assembled checkered board pattern.

3. A puzzle according to claim 1 wherein said markings comprise four different markings and wherein the markings on the obverse side of said puzzle comprise two said markings and wherein the markings on the reverse side of said puzzle comprise the other two markings.

4. A puzzle according to claim 1 wherein said polyomino pieces are selected from monomino, domino, triomino, tetromino, pentomino, hexomino, heptomino and octomino pieces.

5. A puzzle according to claim 4 wherein said polyomino pieces comprise twelve pentomino pieces and one tetromino piece.

6. A puzzle according to claim 1 and including a games board, said board having an outer border and a base, said outer border defining a square recess for receipt of said polyomino pieces, said pieces when assembled occupying substantially all of said recess to define an array of eight by eight alternately marked squares.

7. A puzzle according to claim 6 wherein said base includes one or more apertures to permit displacement and removal of said polyomino pieces from said games board.

8. A puzzle according to claim 1 wherein said pieces are capable of being assembled into a further checkered solution of eight by eight squares such that the squares on one half of said further solution are alternately marked from two of said markings respectively and wherein the squares on the other half of said solution are alternatively marked from two of said markings respectively, there being at least three said markings in said further solution.

9. A puzzle according to claim 1 wherein said pieces are capable of being assembled into a further checkered solution of eight by eight squares such that the outer perimeter squares are alternately marked from two of said markings respectively, and wherein the other squares in said solution are alternately marked from two of said markings respectively, there being at least three said markings in said further solution.

10. A puzzle according to claim 9 wherein said pieces have a height equal to one or more squares and where at least one of said pieces has its lateral sides marked in squares with the markings of said obverse or reverse sides and wherein said pieces are capable of being assembled into a pattern to define a said solution using a said lateral side of said at least one pentomino piece such that said markings other than common markings exchange positions.

11. A puzzle according to claim 1 wherein the height of the sides of the pieces is equal to a multiple of the unit squares forming the obverse and reverse sides of said pieces and wherein said sides laterally of said pieces are marked using the markings of the obverse and reverse sides of said pieces.

12. A puzzle according to claim 11 wherein said pieces are capable of being assembled additionally to form an eight by eight solution with alternate markings and wherein at least one said piece is used with its said lateral side uppermost such that the alternate markings thereon are used to form said eight by eight solution of alternate markings.

13. A puzzle according to claim 12 wherein said pieces are capable of being assembled additionally to form a cube comprising four by four by four unit cubes and wherein all six faces of said cube have alternate markings forming a checkered pattern on each said face.

14. A puzzle according to claim 13 wherein said pieces include one pentomino piece comprising five aligned cubes, said one pentomino piece being omitted to permit the remaining said pieces to form a cube with solid sides but with a hollow portion in its interior.

15. A puzzle according to claim 14 wherein three faces of said cube have their squares carrying two said markings and the other three faces of said cubes having their squares carrying the other two said markings.

16. A puzzle according to claim 11 wherein said pieces include one pentomino piece comprising five aligned cubes, said one pentomino piece being replaced by a further five unit piece comprising a tetromino piece having a cube added thereto and extending to one side thereof, to form said cube.

17. A puzzle according to claim 16 wherein three faces of said cube have their squares carrying two said markings and the other three faces of said cubes having their squares carrying the other two said markings.

18. The puzzle according to claim 1 wherein said solutions using each of the obverse and reverse sides are eight by eight squares.

19. A puzzle comprising a plurality of polomino pieces comprising twelve pentomino pieces and one tetromino piece, each said pentmino piece being of a shape different from the other pentomino pieces and defining one or more squares on opposite sides, the squares of each said piece being alternately marked on the obverse and reverse sides such that said pieces are capable of being assembled using their obverse sides only into one or more solutions comprising squares forming a checkered pattern of alternate markings which may be used for playing a checkers or chess type game, and wherein said pieces are capable of being further assembled using their reverse sides only into one or more solutions comprising squares forming a checkered pattern of alternate makings which may be used for playing a checkers or chess type game, said markings comprising at least three different markings and wherein the assembly of pieces forming said solutions obtained using said obverse sides of said pieces is different from the assembly of pieces forming the solutions obtained using the reverse sides of said pieces.

20. A puzzle according to claim 19 wherein said markings comprise three markings and wherein one said marking is a common marking to the solutions obtained using the obverse and reverse sides of said pieces.

21. A puzzle according to claim 19 wherein said pieces have a height equal to one or more of said squares and wherein at least one of said pentomino pieces has its lateral sides marked in squares with the markings of said obverse or reverse sides to enable creation of a checkered pattern using a lateral side of said at least one pentomino piece.

22. A puzzle according to claim 21 wherein said pieces are capable of being assembled into a checkered eight by eight solution using said lateral side of said one pentomino piece such that one half of said solution, being the first four rows of squares comprises two markings in a checkered pattern and the other half of said solution, being the other four rows of squares comprises two markings in a checkered pattern with one marking being common to both halves of said solution.

23. A puzzle according to claim 22 wherein said halves of said solution comprise halves on opposite diagonal sides of said solution.

24. A puzzle according to claim 19 having four different markings and wherein said assembled solution using the obverse side of said pieces comprises two markings and wherein said assembled solution using the reverse side of said pieces comprises the other two markings.

25. A puzzle according to claim 24 wherein said pieces are capable of being assembled into a further solution of eight by eight squares such that half of said solution comprises two said markings and the other half of said solution comprises the other two said markings.

26. A puzzle according to claim 25 wherein said pieces have a height equal to one or more squares and where at least one of said pieces has its lateral sides marked in squares with the markings of said obverse or reverse sides and wherein said pieces are capable of being assembled into a pattern to define a said solution using a said lateral side of said at least one pentomino piece such that said markings other than common markings exchange positions.

27. A puzzle according to claim 21 wherein said pieces are capable of being assembled into a solution of eight by eight squares with every alternate square comprising a common marking.

28. A puzzle according to claim 27 wherein the first two rows of said squares on opposite sides of said solution have alternate squares of a second marking with the remainder of the alternate squares being a third marking to form a solution defining a chess board.

29. A puzzle according to claim 28 wherein said pieces have a height equal to one or more squares and where at least one of said pieces has its lateral sides marked in squares with the markings of said obverse or reverse sides and wherein said pieces are capable of being assembled into a pattern to define a said solution using a said lateral side of said at least one pentomino piece such that said markings other than common markings exchange positions.

30. A puzzle according to claim 27 wherein the first three rows of said squares on opposite sides of said board have alternate squares of a second marking with the remainder of the alternate squares having a third marking to form a solution defining a checkers board.

31. A puzzle according to claim 19 wherein said pentomino pieces include one piece comprising five aligned squares and wherein said pieces are further capable of being assembled into a cube comprising on each side four by four squares by omitting said one piece to form a cube having a hollow in its interior.

32. A puzzle according to claim 19 wherein said pentomino pieces include a one piece comprising five aligned squares and wherein said pieces are further capable of being assembled into a cube comprising on each side four by four squares by substituting for said one piece, a further composite piece comprising a tetromino piece having a square unit added thereto but extending to one side of said tetromino piece.

33. A puzzle according to claim 19 wherein the height of the sides of the pieces is equal to a multiple of the unit squares forming the obverse and reverse sides of said pieces and wherein said sides laterally of said pieces are marked using the markings of the obverse and reverse sides of said pieces.

34. A puzzle according to claim 33 wherein said pieces are capable of being assembled additionally to form an eight by eight solution with alternate markings and wherein at least one said piece is used with its said lateral side uppermost such that the alternate markings thereon are used to form said eight by eight solution of alternate markings.

35. A puzzle according to claim 22 wherein said pieces are defined by integral of connected cubes defining said squares.

36. A puzzle according to claim 25 wherein said tetromino piece is replaced by a triomino piece and a monomino piece.

37. A puzzle according to claim 36 wherein said pieces include a straight pentomino piece comprising five cubes, said monomino, triomino, and pentomino pieces have their sides laterally of said obverse and reverse sides marked such as to allow formation of a chess board of the type having eight by eight squares with every alternate square comprising said common marking.

38. A puzzle according to claim 34 wherein said pieces are capable of being assembled additionally to form a cube comprising four by four by four unit cubes and wherein all six faces of said cube have alternate markings forming a checkered pattern on each said face.

39. A puzzle according to claim 33 wherein said pieces include one pentomino piece comprising five aligned cubes, said one pentomino piece being replaced by a further five unit piece comprising a tetromino piece having a cube added thereto and extending to one side thereof, to form said cube.

40. A puzzle according to claim 38 wherein said pieces include one pentomino piece comprising five aligned cubes, said one pentomino piece being omitted to permit the remaining said pieces to form a cube with solid sides but with a hollow portion in its interior.

41. A puzzle according to claim 39 wherein three faces of said cube have their squares carrying two said markings and the other three faces of said cubes having their squares carrying the other two said markings.

42. A puzzle according to claim 40 wherein three faces of said cube have their squares carrying two said markings and the other three faces of said cubes having their squares carrying the other two said markings.

43. A puzzle according to claim 19 and including a further set of the twelve pentomino pieces, said pieces being capable of being assembled into a five by five by five unit cube using all pentomino pieces and either one or no tetromino pieces.

44. The puzzle according to claim 19 wherein said solutions using each of the obverse and reverse sides are eight by eight squares.

45. A puzzle comprising on a computer or video screen images of a plurality of polyomino pieces, each said piece having opposite sides and the opposite sides of each image defining one or more squares, each square having markings, the images of said pieces on the obverse side only being capable of being assembled into an array defining squares having a checkered pattern of said markings and said images of said pieces on the reverse side only being capable of being assembled into a further array defining squares having a checkered pattern of said markings, there being at least three different markings in total on said opposite sides of the images of said pieces, and wherein the assembly of images of said pieces forming the arrays obtained using the obverse sides of said images is different from the assembly of images of said pieces forming the arrays obtained using the reverse sides of said images.

46. The puzzle according to claim 45 wherein said solutions using each of the obverse and reverse sides are eight by eight squares.

47. A puzzle according to claim 1 wherein said pieces are capable of being assembled into a further checkered solution of squares such that some of the squares from the obverse side and the remainder of the squares from the reverse side are used to form said further checkered solution.

48. A puzzle including a plurality of polyomino pieces, each said piece having on opposite sides one or more squares, said squares in each said piece and on said opposite sides having markings such that said pieces are capable of being assembled using their obverse sides only into one or more solutions comprising squares with the markings of the squares on said obverse side of said assembled pieces forming a checkerboard pattern of two alternate markings which may be used for playing a checkers or chess type game, and wherein said pieces may be further assembled using their reverse sides only into one or more solutions comprising squares forming a further checkerboard pattern of two alternate markings, said markings of said squares in total on both sides of said pieces comprise three or more different markings and when any assembly of pieces forming said solution is obtained using the obverse sides of said pieces, said reverse side of said puzzle is a pattern other than a checkerboard pattern.

49. A puzzle comprising a plurality of polyomino pieces, each of said pieces having two sides, and each of said sides comprising one or more squares, said squares having one of three markings, each side of said pieces comprising squares on opposite sides thereof, said pieces having first unique markings and a common marking on one side thereof and a second unique marking and a common marking on the other side thereof, said pieces with sides having first unique markings capable of being assembled in one or more ways to form a solution to said puzzle, said solution comprising a checkerboard pattern of said unique marking and said common marking, said pieces with sides having said second unique marking capable of being assembled in one or more different ways to form a solution to the puzzle, said solution comprising a checkerboard pattern of said other unique marking and said common marking, wherein, said arrangement of said pieces forming said solutions for said pieces with sides having one unique marking is different than the arrangement of said pieces forming the solution for said pieces with sides having the other unique marking.

50. The puzzle according to claim 49 comprising a first plurality of said pieces having squares of one unique marking on one side of said pieces positioned opposite to squares on the opposite side of said pieces having said other unique marking, and a second plurality of said pieces having squares of one unique marking on one side of said pieces positioned opposite to squares on the opposite side of said pieces having said common marking.

51. The puzzle according to claim 49 wherein said polyomino pieces comprise twelve pieces with five squares per side and one piece with four squares on each side.

52. The puzzle according to claim 51 wherein all of said twelve pieces with five squares per side have a different shape.

53. The puzzle according to claim 49 wherein said arrangement of said pieces forming said solution to said puzzle comprises a checkerboard pattern including first and second unique marking and the common marking.

54. A puzzle comprising a plurality of polyomino pieces, each of said pieces having two sides, and each of said sides comprising one or more squares, said squares having one of three markings, each side of said pieces comprising squares on opposite sides thereof, said pieces having first unique markings and a common marking on one side thereof and a second unique marking and the common marking on the other side thereof, some of said pieces with sides having first unique markings and some of said pieces having second unique markings capable of being assembled in one or more ways to form a solution to said puzzle, said solution comprising a checkerboard pattern of said first and second unique markings and said common marking, wherein, said arrangement of said pieces forming said solutions on one of said sides is different than the arrangement of said pieces forming solutions for said pieces on the other of said sides.

* * * * *